US008575518B2

(12) United States Patent
Walsh

(10) Patent No.: US 8,575,518 B2
(45) Date of Patent: Nov. 5, 2013

(54) CONVECTIVE HEATER

(75) Inventor: Ryan Walsh, Los Angeles, CA (US)

(73) Assignee: Gentherm Incorporated, Northville, MI (US)

( * ) Notice: Subject to any disclaimer, the term of this patent is extended or adjusted under 35 U.S.C. 154(b) by 532 days.

(21) Appl. No.: 12/695,602

(22) Filed: Jan. 28, 2010

(65) Prior Publication Data

US 2010/0193498 A1 Aug. 5, 2010

Related U.S. Application Data

(60) Provisional application No. 61/148,019, filed on Jan. 28, 2009.

(51) Int. Cl.
*H05B 1/00* (2006.01)

(52) U.S. Cl.
USPC ..... 219/217; 219/540

(58) Field of Classification Search
USPC ..... 219/217, 540
See application file for complete search history.

(56) References Cited

U.S. PATENT DOCUMENTS

| | | | |
|---|---|---|---|
| 1,839,156 | A | 12/1931 | Lumpkin |
| 3,136,577 | A | 6/1964 | Richard |
| 3,137,523 | A | 6/1964 | Karner |
| 3,627,299 | A | 12/1971 | Schwartze et al. |
| 3,640,456 | A | 2/1972 | Sturgis |
| 3,786,230 | A | 1/1974 | Brandenburg, Jr. |
| 3,876,860 | A | 4/1975 | Nomura et al. |
| 3,916,151 | A | 10/1975 | Reix |
| 3,927,299 | A | 12/1975 | Sturgis |
| 4,044,824 | A | 8/1977 | Eskeli |
| 4,124,794 | A | 11/1978 | Eder |

(Continued)

FOREIGN PATENT DOCUMENTS

| | | |
|---|---|---|
| DE | 10238552 | 8/2001 |
| DE | 10115242 | 10/2002 |
| WO | WO 02/11968 | 2/2002 |
| WO | WO 03/051666 | 6/2003 |

OTHER PUBLICATIONS

Feher, Steve, Thermoelectric Air Conditioned Variable Temperature Seat (VTS) & Effect Upon Vehicle Occupant Comfort, Vehicle Energy Efficiency, and Vehicle Environment Compatibility, SAE Technical Paper, Apr. 1993, pp. 341-349.

(Continued)

*Primary Examiner* — Marcos D. Pizarro
*Assistant Examiner* — Sue Tang
(74) *Attorney, Agent, or Firm* — Knobbe, Martens, Olson & Bear LLP

(57) ABSTRACT

A heating device comprises a heater having a first surface and a second surface, with the second surface being generally opposite of the first surface. The heater is configured to receive an electrical current and convert it to heat. The heating device additionally includes at least one heat transfer assembly positioned along the first and/or second surface of the heater. In one embodiment, the heat transfer assembly includes a plurality of fins that generally define a plurality of fin spaces through which fluids may pass. In some arrangements, the heating device comprises an outer housing that at least partially surrounds the heater and one or more of the heat transfer assemblies. Heat generated by the heater is transferred to the fins of the heat transfer assembly. In addition, fluids passing through the fin spaces are selectively heated when electrical current is provided to the heater.

26 Claims, 30 Drawing Sheets

(56) References Cited

U.S. PATENT DOCUMENTS 4,195,687 A 4/1980 Taziker
4,223,205 A 9/1980 Sturgis
4,336,444 A 6/1982 Bice et al.
4,413,857 A 11/1983 Hayashi
4,518,847 A 5/1985 Horst, Sr. et al.
4,567,351 A 1/1986 Kitagawa et al.
4,671,567 A 6/1987 Frobose
4,685,727 A 8/1987 Cremer et al.
4,791,274 A 12/1988 Horst
4,923,248 A 5/1990 Feher
5,002,336 A 3/1991 Feher
5,077,709 A 12/1991 Feher
5,106,161 A 4/1992 Meiller
5,111,025 A 5/1992 Barma et al.
5,117,638 A 6/1992 Feher
5,187,349 A 2/1993 Curhan et al.
5,256,857 A * 10/1993 Curhan et al. ..... 219/202
5,278,936 A 1/1994 Shao
5,385,382 A 1/1995 Single, II et al.
5,597,200 A 1/1997 Gregory et al.
5,606,639 A * 2/1997 Lehoe et al. ..... 392/353
5,626,021 A 5/1997 Karunasiri et al.
5,721,804 A 2/1998 Greene, III
5,850,741 A 12/1998 Feher
5,887,304 A 3/1999 Von der Heyde
5,902,014 A 5/1999 Dinkel et al.
5,921,314 A 7/1999 Schuller et al.
5,924,766 A 7/1999 Esaki et al.
5,927,817 A 7/1999 Ekman et al.
5,934,748 A 8/1999 Faust et al.
5,995,711 A 11/1999 Fukuoka et al.
6,003,950 A 12/1999 Larsson
6,019,420 A 2/2000 Faust et al.
6,048,024 A 4/2000 Wallman
6,059,018 A 5/2000 Yoshinori et al.
6,062,641 A 5/2000 Suzuki et al.
6,072,938 A 6/2000 Peterson et al.
6,073,998 A 6/2000 Siarkowski et al.
6,079,485 A 6/2000 Esaki et al.
6,085,369 A 7/2000 Feher
6,087,638 A 7/2000 Silverbrook
6,119,463 A 9/2000 Bell
6,145,925 A 11/2000 Eksin et al.
6,178,292 B1 1/2001 Fukuoka et al.
6,186,592 B1 2/2001 Orizaris et al.
6,189,966 B1 2/2001 Faust et al.
6,196,627 B1 3/2001 Faust et al.
6,206,465 B1 3/2001 Faust et al.
6,223,539 B1 5/2001 Bell
6,263,530 B1 7/2001 Feher
6,509,704 B1 1/2003 Brown
6,541,743 B2 4/2003 Chen
RE38,128 E 6/2003 Gallup et al.
6,571,564 B2 6/2003 Upadhye et al.
6,598,251 B2 7/2003 Habboub et al.
6,604,576 B2 8/2003 Noda et al.
6,604,785 B2 8/2003 Bargheer et al.
6,606,866 B2 8/2003 Bell
6,619,736 B2 9/2003 Stowe et al.
6,626,488 B2 9/2003 Pfahler
6,644,735 B2 11/2003 Bargheer et al.
6,676,207 B2 1/2004 Rauh et al.
6,700,052 B2 3/2004 Bell
6,761,399 B2 7/2004 Bargheer et al.
6,772,829 B2 8/2004 Lebrun
6,786,541 B2 9/2004 Haupt et al.
6,786,545 B2 9/2004 Bargheer et al.
6,790,481 B2 9/2004 Bishop et al.
6,808,230 B2 10/2004 Buss et al.
6,817,675 B2 11/2004 Buss et al.
6,828,528 B2 12/2004 Stowe et al.
6,841,957 B2 1/2005 Brown
6,855,880 B2 2/2005 Feher
6,857,697 B2 2/2005 Brennan et al.
6,893,086 B2 5/2005 Bajic et al.
6,907,739 B2 6/2005 Bell
6,954,944 B2 10/2005 Feher
6,963,053 B2 11/2005 Lutz
6,976,734 B2 12/2005 Stoewe
6,977,360 B2 12/2005 Weiss
7,040,710 B2 5/2006 White et al.
7,070,232 B2 7/2006 Minegishi et al.
7,075,034 B2 7/2006 Bargheer et al.
7,108,319 B2 9/2006 Hartwich et al.
7,114,771 B2 10/2006 Lofy et al.
7,124,593 B2 10/2006 Feher
7,131,689 B2 11/2006 Brennan et al.
7,147,279 B2 12/2006 Bevan et al.
7,168,758 B2 1/2007 Bevan et al.
7,178,344 B2 2/2007 Bell
7,201,441 B2 4/2007 Stoewe et al.
7,220,048 B2 5/2007 Kohlgrüber et al.
7,231,772 B2 6/2007 Bell
7,272,936 B2 9/2007 Feher
7,425,034 B2 9/2008 Bajic et al.
7,462,028 B2 12/2008 Cherala et al.
7,475,464 B2 1/2009 Lofy et al.
7,480,950 B2 1/2009 Feher
7,506,924 B2 3/2009 Bargheer et al.
7,506,938 B2 3/2009 Brennan et al.
7,581,785 B2 9/2009 Heckmann et al.
7,587,901 B2 9/2009 Petrovski
7,591,507 B2 9/2009 Giffin et al.
7,621,594 B2 11/2009 Hartmann et al.
7,640,754 B2 1/2010 Wolas
7,665,803 B2 2/2010 Wolas
7,708,338 B2 5/2010 Wolas
RE41,765 E 9/2010 Gregory et al.
7,827,620 B2 11/2010 Feher
7,827,805 B2 11/2010 Comiskey et al.
7,862,113 B2 1/2011 Knoll
7,866,017 B2 1/2011 Knoll
7,877,827 B2 2/2011 Marquette et al.
7,937,789 B2 5/2011 Feher
7,963,594 B2 6/2011 Wolas
7,966,835 B2 6/2011 Petrovski
7,996,936 B2 8/2011 Marquette et al.
8,065,763 B2 11/2011 Brykalski et al.
8,104,295 B2 1/2012 Lofy
8,143,554 B2 3/2012 Lofy
8,181,290 B2 5/2012 Brykalski et al.
8,191,187 B2 6/2012 Brykalski et al.
8,222,511 B2 7/2012 Lofy
8,256,236 B2 9/2012 Lofy
8,332,975 B2 12/2012 Brykalski et al.
8,402,579 B2 3/2013 Marquette et al.
8,418,286 B2 4/2013 Brykalski et al.
8,434,314 B2 5/2013 Comiskey et al.
8,438,863 B2 5/2013 Lofy
2002/0017102 A1 2/2002 Bell
2003/0145380 A1 8/2003 Schmid
2004/0090093 A1 5/2004 Kamiya et al.
2004/0255364 A1 12/2004 Feher
2005/0067862 A1 3/2005 Iqbal et al.
2005/0285438 A1 12/2005 Ishima et al.
2006/0053529 A1 3/2006 Feher
2006/0078319 A1 4/2006 Maran
2006/0087160 A1 4/2006 Dong et al.
2006/0137099 A1 6/2006 Feher
2006/0137358 A1 6/2006 Feher
2006/0175877 A1* 8/2006 Alionte et al. ..... 297/180.14
2006/0214480 A1 9/2006 Terech
2006/0219699 A1 10/2006 Geisel et al.
2006/0273646 A1 12/2006 Comiskey et al.
2007/0086757 A1 4/2007 Feher
2007/0145808 A1 6/2007 Minuth et al.
2007/0200398 A1 8/2007 Wolas et al.
2007/0204629 A1 9/2007 Lofy
2007/0251016 A1 11/2007 Feher
2007/0262621 A1 11/2007 Dong et al.
2007/0277313 A1 12/2007 Terech
2008/0000025 A1 1/2008 Feher
2008/0047598 A1 2/2008 Lofy
2008/0087316 A1 4/2008 Inaba et al.

(56) References Cited

U.S. PATENT DOCUMENTS

| | | | |
|---|---|---|---|
| 2008/0148481 | A1 | 6/2008 | Brykalski et al. |
| 2008/0164733 | A1 | 7/2008 | Giffin et al. |
| 2008/0166224 | A1 | 7/2008 | Giffin et al. |
| 2008/0173022 | A1 | 7/2008 | Petrovski |
| 2008/0223841 | A1 | 9/2008 | Lofy |
| 2009/0000031 | A1 | 1/2009 | Feher |
| 2009/0025770 | A1 | 1/2009 | Lofy |
| 2009/0026813 | A1 | 1/2009 | Lofy |
| 2009/0033130 | A1 | 2/2009 | Marquette et al. |
| 2009/0126110 | A1 | 5/2009 | Feher |
| 2009/0193814 | A1 | 8/2009 | Lofy |
| 2009/0218855 | A1 | 9/2009 | Wolas |
| 2010/0011502 | A1 | 1/2010 | Brykalski et al. |
| 2010/0193498 | A1 | 8/2010 | Walsh |
| 2011/0115635 | A1 | 5/2011 | Petrovski et al. |
| 2011/0253340 | A1 | 10/2011 | Petrovski |
| 2011/0296611 | A1 | 12/2011 | Marquette et al. |
| 2012/0080911 | A1 | 4/2012 | Brykalski et al. |
| 2012/0104000 | A1 | 5/2012 | Lofy |
| 2012/0114512 | A1 | 5/2012 | Lofy et al. |
| 2012/0131748 | A1 | 5/2012 | Brykalski et al. |
| 2012/0227182 | A1 | 9/2012 | Brykalski et al. |
| 2012/0319439 | A1 | 12/2012 | Lofy |
| 2013/0086923 | A1 | 4/2013 | Petrovski et al. |
| 2013/0097776 | A1 | 4/2013 | Brykalski et al. |
| 2013/0097777 | A1 | 4/2013 | Marquette et al. |

OTHER PUBLICATIONS

Lofy, J. et al., Thermoelectrics for Environmental Control in Automobiles, Proceeding of Twenty-First International Conference on Thermoelectrics (ICT 2002), published 2002, pp. 471-476.

International Search Report for Application No. PCT/US2010/022429 dated Mar. 23, 2010, which claims priority from the same U.S. provisional application as U.S. Appl. No. 12/695,602.

* cited by examiner

CONVECTIVE HEATER

CROSS REFERENCE TO RELATED APPLICATIONS

This application claims the priority benefit under 35 U.S.C. §119(e) of U.S. Provisional Patent Application No. 61/148,019, filed Jan. 28, 2009, the entirety of which is hereby incorporated by reference herein.

BACKGROUND

1. Field of the Inventions

This application generally relates to heating devices and systems, and more specifically, to convective heating devices and systems configured for use in climate controlled (e.g., heated, ventilated, etc.) seating assemblies.

2. Description of the Related Art

Temperature modified air for environmental control of an automobile, other vehicles or any other living or working space is typically provided to relatively extensive areas, such as an entire automobile interior, selected offices or suites of rooms within a building (e.g., houses, hospitals, office buildings, etc.) and the like. In the case of enclosed areas, such as automobiles, trains, airplanes, other vehicles, homes, offices, hospitals, other medical facilities, libraries and the like, the interior space is typically heated and/or cooled as a unit. There are many situations, however, in which more selective or restrictive air temperature modification is desirable. For example, it is often desirable to provide an individualized climate control for a seat assembly so that substantially instantaneous heating or cooling can be achieved. For example, a vehicle seat, chair or other seat assembly situated in a cold environment can be uncomfortable to the occupant. Furthermore, even in conjunction with other heating methods, it may be desirable to quickly warm the seat to enhance the occupant's comfort, especially where other heating units (e.g., automobile's temperature control system, home's central heater, etc.) take a relatively long time to warm the ambient air. Therefore, a need exists to provide a heating system to selectively heat one or more portions of a climate-controlled vehicle seat, bed, other seat assembly and/or other item or device.

SUMMARY

According to some embodiments of the present application, a heating device comprises a heater having a first surface and a second surface, with the second surface being generally opposite the first surface. The heater is configured to receive an electrical current and convert it to heat. The heating device additionally includes at least one heat transfer assembly positioned along the first and/or second surface of the heater. In one embodiment, the heat transfer assembly includes a plurality of fins that generally define a plurality of fin spaces therebetween through which fluids may pass. In some arrangements, the heating device comprises an outer housing that at least partially surrounds the heater and one or more of the heat transfer assemblies. Heat generated by the heater is transferred to the fins of the heat transfer assembly. In addition, fluids passing through the fin spaces are selectively heated when electrical current is provided to the heater.

In some embodiments, the heating device further includes a connector that is in electrical communication with the conductive leads of the heater. In some embodiments, the connector is configured to connect to a coupling for delivering electrical current to the heater. In other arrangements, the heat transfer assembly comprises a ceramic, metal and/or any other material. In one embodiment, the heater comprises a resistive heater, a thick-film heater and/or any other type of heater. In other embodiments, the outer housing comprises foam (e.g., Volara®), fiberglass, other polymeric materials and/or the like.

In other configurations, the heating device further includes a second heat transfer assembly, so that the heater includes a heat transfer assembly on both of its surfaces. According to some embodiments, the heater and one or more heat transfer assemblies are secured to each other using one or more clips, screws, bolts, other mechanical fasteners, adhesives and/or the like. In other arrangements, the heater and at least one heat transfer assembly form a unitary structure. In one embodiment, the heater is generally disposed along a base of the heat transfer assembly.

According to some embodiments, a convective heating device for thermally conditioning a fluid includes a heat transfer assembly having a base. Such a base can include a first side and a second side generally opposite the first side. The first side includes a plurality of fins or other heat transfer members that generally define a plurality of fin spaces therebetween through which a fluid may pass. The fins or other heat transfer members can have generally vertical orientation and may attach to the base along one end. In other arrangements, the fins comprise a folded design, with adjacent fins being parallel or non-parallel with each other. The heating device further includes at least one electrically conductive member configured to receive an electrical current and convert such current to heat. In some embodiments, the heater is positioned along the second side of the base of the heat transfer assembly such that the heat transfer assembly and the heater comprise a generally unitary structure. In some configurations, heat generated by the heater is transferred to the fins of the heat transfer assembly. Air or other fluids passing through the fin spaces can be selectively heated when electrical current is provided to the heater.

In certain embodiments, the convective heating device further includes a housing adapted to at least partially surround the heat transfer assembly and the heater. In other arrangements, the heat transfer assembly comprises ceramic, metal or any another material having favorable heat conductive properties. In one embodiment, the convective heating device additionally comprises a connector in electrical communication with at least one electrically conductive member of the heater. In some arrangements, such a connector is configured to connect to a coupling for delivering electrical current to the heating device.

According to some embodiments of the present application, a climate control system for a seating assembly comprises a heating device having a heater. The heater includes a first surface and a second surface generally opposite of the first surface. Further, the heater is configured to receive an electrical current and convert such current to heat. The heating device further comprises at least one heat transfer assembly positioned along the first and/or second surface of the heater. The heat transfer assembly includes a plurality of fins that define a plurality of fin spaces therebetween through which fluids may be directed. In some arrangements, the heating device additionally includes an outer housing that at least partially surrounds the heater and one or more heat transfer assemblies. Heat generated by the heater is transferred to the fins of the heat transfer assembly, and fluids passing through the fin spaces can be selectively heated when electrical current is provided to the heater. The climate control system further includes a fluid transfer device configured to move fluids through the heating device and an outlet conduit located downstream of the heating device and the fluid transfer device. In some embodiments, the outlet conduit is configured to deliver thermally conditioned fluid to a seating assembly.

In some embodiments, the climate control system is configured for use in a vehicle seat, an office chair, a bed, a sofa, a wheelchair or any other seating device. In one arrangement, the heating device is positioned within a housing of the fluid transfer device. In other configurations, the heating device is positioned upstream or downstream of the fluid transfer device. In other arrangements, the climate control system additionally includes a thermoelectric device (e.g., Peltier device) to selectively cool fluids being delivered to the outlet conduit.

According to some embodiments, a heating device for convectively heating a fluid includes a first heat transfer assembly comprising a plurality of fins, such that the fins define a plurality of fin spaces therebetween through which fluids can be selectively passed. In one embodiment, the first heat transfer assembly comprises a base having a first side and a second side generally opposite of the first side. In some embodiments, the fins or other heat transfer members extend from the first side of the base. In one embodiment, the heating device additionally includes at least one electrical conducting member positioned along at least a portion of the second side of the base, wherein the electrical conducting member is configured to receive electrical current and convert said electrical current to heat. The heating device can additionally include an outer housing that at least partially surrounds the first heat transfer member and/or any other portion of the device. In some embodiments, heat generated at or near the electrical conducting member is transferred to the plurality of fins of the first heat transfer assembly. In certain arrangements, fluids directed through the fin spaces are selectively heated when electrical current is provided to the heating device.

According to some embodiments, the first heat transfer assembly and the one or more electrical conducting members comprise a generally unitary structure. For example, the heat transfer assembly and the conducting members can be permanently or removably joined to one another. In alternative embodiments, the conducting members are directly formed onto one or more surfaces of the heat transfer assembly. In some embodiments, at least one electrical conducting member is formed directly on the base of the first heat transfer assembly.

In another embodiment, at least one electrical conducting member is part of a heater (e.g., thick-film heater, thin-film heater, other type of heater, etc.) secured to the base of the first heat transfer assembly. In some arrangements, at least one electrical conducting member comprises a conductive material positioned on the base of the first heat transfer assembly. In one embodiment, at least one electrical conducting member comprises a conductive material positioned on an electrically non-conductive base of the first heat transfer assembly.

According to some embodiments, the conductive material comprises a metal (e.g., copper, silver, other metals or alloys, etc.). In some embodiments, the conductive material comprises an electrically conductive carbon material and/or any other conductive material, either in lieu of or in additional to a metal. In other embodiments, the conductive material comprises a conductive ink. In one embodiment, the conductive material is deposited on the base using spraying, coating, printing, plating and/or any other method. In some embodiments, the first heat transfer assembly comprises an electrically non-conductive material (e.g., molded plastic, other polymeric materials, ceramic, etc.).

According to certain arrangements, the heating device additionally comprises an electrical connector or other coupling in electrical communication with at least one electrical conducting member, wherein such a connector is configured to connect to a coupling for the selective delivery of electrical current to the heating device. In one embodiment, the heating device further includes at least a second heat transfer assembly. In some embodiments, a second heat transfer assembly extends in a direction generally away from the second side of the base.

According to some embodiments, the heater and the first heat transfer assembly of the heater device are attached using adhesives, thermal grease, clips, bolts, other mechanical fasteners and/or any other connection device or method. In some embodiments, a Temperature Coefficient of Resistance (TCR) of at least one electrical conducting member is between about 1,500 and 3,500 ppm/° C. (e.g., about 1,500, 1,600, 1,700, 1,800, 1,900, 2,000, 2,100, 2,2000, 2,300, 2,400, 2,500, 2,600, 2,700, 2,800, 2,900, 3,000, 3,100, 3,200, 3,300, 3,400, 3,500 ppm/° C., ranges between such values, etc.). In other embodiments, the TCR of at least one conducting member is less than 1,500 ppm/° C. (e.g., between about 0 and 1,500 ppm/° C.) or greater than 3,500 ppm/° C. (3,550, 3,600, 3,700, 3,800, 3,900, 4,000, 4,500, 5,000, 5,500, 6,000 ppm/° C., values greater than 6,000 ppm/° C., ranges between such values, etc.).

According to some embodiments, a climate control system for a seating assembly includes a heating device for thermally conditioning a fluid. In some arrangements, the heating device of the climate control system comprises a heat transfer assembly having a base which includes a first side and a second side, wherein the second side is generally opposite of the first side and wherein the first side comprises a plurality of heat transfer members through or near which fluid is configured to selectively pass. The heating device additionally includes a heater comprising at least one electrically conductive member which is configured to receive electrical current and convert it electrical current to heat. In some embodiments, at least a portion of the heat generated by the heater is transferred to the heat transfer members of the heat transfer assembly. In one embodiment, fluids passing through or near the heat transfer members are selectively heated when electrical current is provided to the heater. According to certain arrangements, the climate control system further comprises a fluid transfer device (e.g., fan, blower, etc.) configured to move fluid through the heating device and an outlet conduit located downstream of the heating device and the fluid transfer device, such that the outlet conduit is configured to deliver thermally conditioned fluid to a seating assembly.

According to some embodiments, the heater of the climate control system is positioned along the second side of the base of the heat transfer assembly such that the heat transfer assembly and the heater comprise a generally unitary structure. In another embodiment, at least one electrically conductive member comprises a conductive material formed directly on the base of the first heat transfer assembly. In other embodiments, at least one conductive material is deposited on the base using spraying, coating, printing, plating and/or any other device or method. In some embodiments, the climate control system is configured for use in an automobile seat or other vehicle seat. In other embodiments, the climate control system is configured for use in a bed (e.g., standard bed, hospital or other medical bed, etc.) and/or any other type of seating assembly (e.g., wheelchair, theater seat, office chair, sofa, etc.). In other embodiment, the heating device and/or other components of the climate control system are adapted to be used to thermally condition other types of devices or specific areas or regions. In some embodiments, the heating device is positioned within a housing of the fluid transfer device. In other arrangements, the heating device is positioned upstream or downstream of the fluid transfer device (e.g., fan, blower, etc.). In another embodiment, the climate control system additionally includes one or more thermoelectric devices (e.g., Peltier circuit, another type of heat pump, etc.) and/or other types of heating and/or cooling devices to selectively cool fluids being delivered to the outlet conduit. In one embodiment, a Temperature Coefficient of Resistance (TCR) of the at least one electrically conductive member is between about 1,500 and 5,000 ppm/° C.

BRIEF DESCRIPTION OF THE DRAWINGS

These and other features, aspects and advantages of the present application are described with reference to drawings of certain embodiments, which are intended to illustrate, but not to limit, the present inventions. The drawings include forty-four (44) figures. It is to be understood that these drawings are for the purpose of illustrating concepts of the present inventions and may not be to scale.

DETAILED DESCRIPTION OF THE PREFERRED EMBODIMENTS

Figure 1:
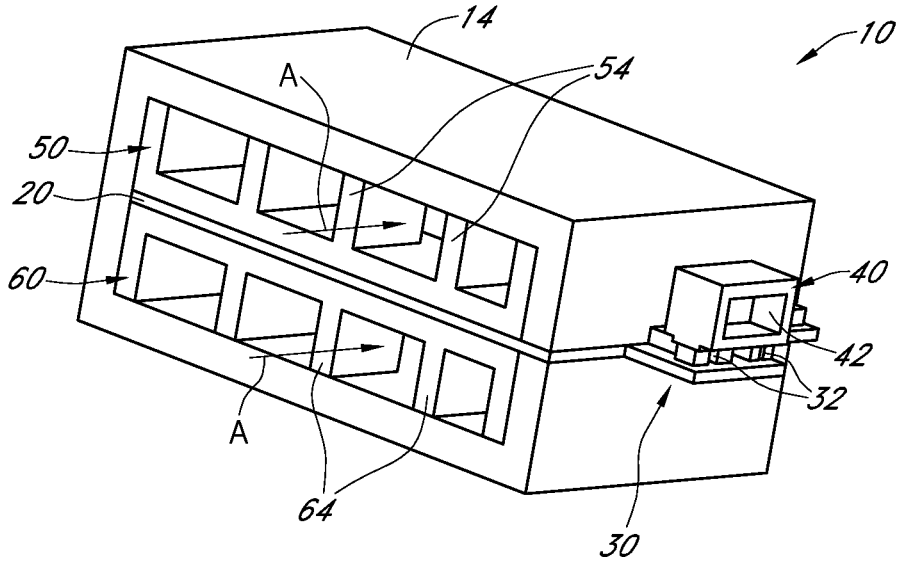
FIG. 1 schematically illustrates a perspective view of one embodiment of a heating device configured for use in a climate controlled seat assembly.

The discussion below and the figures referenced herein describe various embodiments of heating devices, devices and systems configured to include such a heating devices and methods utilizing such devices or systems. A number of embodiments of such devices, systems and methods are particularly well suited to provide heated air or other fluids to one or more portions of vehicle seats (e.g., seat back portion, seat bottom portion, neck portion, headrest region, other portions of an automotive seat or other vehicle seat, etc.). However, the heating devices, systems and other components (e.g., blowers, fans, other fluid transfer devices, housings, thermoelectric devices, etc.) making use of such heating devices and other thermally conditioning features disclosed herein may be incorporated into other types of seat assemblies, including, without limitation, beds (e.g., hospital beds, other medical beds, beds for home use, hotel beds, etc.), recliner chairs, sofas, office chairs, airplane seats, motorcycle seats, other vehicle seats, stadium seats, benches, wheelchairs, outdoor furniture, massage chairs and the like. Alternatively, such devices, systems and methods can be used to selectively heat any other device or system. In addition, the devices or systems disclosed herein can be used to spot heat or otherwise deliver a volume of heated air to one or more targeted areas of a vehicle (e.g., A, B and/or C pillars, dashboard, visor, headliner, etc.), vehicle seat, bed or other seating assembly, office or other location. As used herein, the term "fluid" is a broad term and is used in accordance with its ordinary meaning, and may include, without limitation, gases (e.g., ambient air, oxygen, etc.), liquids, non-Newtonian fluids, any other flowable materials, combinations thereof and/or the like.

The various embodiments of the heating devices and systems disclosed herein offer a number of advantages over currently available heaters for seat assemblies. For example, heater mats and other existing systems currently being used in climate controlled seat assemblies are susceptible to overheating and fire danger. Such mats typically require the placement of resistive wires and other electrical connections within a seating assembly, sometimes directly underneath the seating assembly surface. Thus, these wires and other electrical connections and components are subject to breaking, tearing and/or otherwise becoming damaged, especially with the passage of time and excessive use. Further, heater mats and similar heating systems can suffer from durability, occupant detection and other comfort-related problems. In addition, such components can short out, exposing the user to potentially dangerous conditions and relatively expensive and complex repairs and maintenance procedures.

In addition, when conventional heater mats are used to provide heat to a climate control seat assembly, a supplier and/or assembler may be required to install two separate items into the seat assembly, a heater mat for heating purposes and a fluid module configured to provide conditioned and/or ambient air for cooling or venting purposes. In at least some of the various embodiments of heating systems disclosed herein or variations thereof, the need for a separate heating mat or other type of conductive heater is eliminated. Thus, as discussed in greater detail herein, a single heating device or system can be used to provide both heat and/or venting (e.g., unheated air delivered into a seat assembly by the heating system's fluid transfer device). Accordingly, the complexity of the climate control system and/or its cost can be advantageously reduced. In addition, repairing, servicing and/or performing other maintenance tasks can be facilitated by the embodiments of heating systems disclosed herein.

FIG. 1 illustrates a perspective view of one embodiment of a heating device 10. As shown, the heating device 10 can include a heater 20 and heat transfer assemblies 50, 60 on one or both sides of the heater 20. Each heat transfer assembly 50, 60 can include a plurality of fins 54, 64 or other heat transfer members. As discussed in greater detail herein, the fins 54, 64 can be configured to help transfer heat away from the surface of the heater 20. According to some arrangements, the device 10 includes a housing 14 that at least partially encloses the heater 20, the heat transfer assemblies 50, 60 and any other components of the device 10. For example, in the depicted embodiment, the housing 14 surrounds the entire periphery of the heating device 10. According to some embodiments, the heating device 10 includes a single housing 14 that is configured to at least partially enclose the various components of the device. However, in other embodiments, the housing 14 comprises two or more portions that are permanently or removably joined to one another using one or more attachment devices or methods (e.g., adhesives, screws, tabs or other fasteners, welds, etc.).

The housing 14 can include one or more thermally-insulating materials, such as, for example, foam, plastic, other polymeric materials, fiberglass and/or the like. According to some arrangements, the housing 14 comprises a rigid or semi-rigid structure that is configured to generally resist deformation when exterior forces or stresses act upon it. Alternatively, the housing 14 can include a flexible material, such as, for example, a wrap, one or more layers or sheets of foam, cloth, fabric and/or the like. In one embodiment, the housing comprises a fine-celled, flexible foam (e.g., Volara®) that has desirable physical, chemical, thermal-insulation and other properties. The housing 14 or other portions of the device can include other features or components to further enhance the thermal insulation properties of the device 10. For example, gas assist injection molding and/or structural foam molding methods can be utilized in the manufacture of the housing. In other embodiments, the housing 14 is provided with an interior barrier layer (e.g., air, foam, etc.) that further enhances its thermal insulation properties. Any other device or method of improving the thermal insulating properties of the housing 14 and/or other portions of the heating device 10 can be used. In addition, thermal insulation members can be placed, either continuously or intermittently, along one or more portions of a heating system (e.g., downstream conduits), as desired or required.

With continued reference to the arrangement illustrated in FIG. 1, the heating device 10 is configured to permit air to be selectively passed between adjacent fins 54, 64 or other heat exchange members (e.g., in a direction generally represented by arrows A). Consequently, as discussed in greater detail herein, air (or other fluid) that passes through the heating device 10 can be convectively heated. Such heating can be caused by the transfer of heat from the fins 54, 64 or other heat exchange members to the air or other fluid passing adjacent thereto. Accordingly, thermally conditioned (e.g., heated) air or other fluid can be delivered to one or more portions of a climate controlled seating assembly or other device or system.

In some arrangements, the heating device 10 comprises a connector 40 that is used to easily and conveniently connect or disconnect the device 10 to or from a power source (e.g., a vehicles electrical system, a battery, another AC or DC power source, etc.). Further, the connector 40 can be configured to place the heating device 10 in data communication with a controller, processor or other electrical device, as desired or required. The connector 40 can include a recess 42 or other opening that is sized, shaped and otherwise configured to receive a corresponding coupling or other mating portion (not shown). In some embodiments, the corresponding coupling or other mating portion (e.g., a male connector in electrical communication with a power source) can be securely coupled to the connector 40 of the device 10 using a snap fitting or other attachment device or method (e.g., clips, other engagement features, etc.).

With reference to FIG. 1, the depicted connector 40 is positioned on and secured to a protruding portion 30 of the heater 20. As shown, such a protruding portion 30 can extend beyond the edge of the housing 14. In some arrangements, the protruding portion 30 forms a unitary structure with the heater 20. Alternatively, the protruding portion 30 can be a separate item that is attached to or is otherwise maintained in a desired relationship with respect to the adjacent heater 20. Regardless of the exact configuration and other details and design of the heating device 10, the electrical leads 32 of the heater 20 can advantageously terminate at the connector 40 to selectively energize the heater 20 when the connector 40 is attached to a power source. The electrical leads can include silver traces or other metallic or non-metallic conductive materials.

Figure 2:
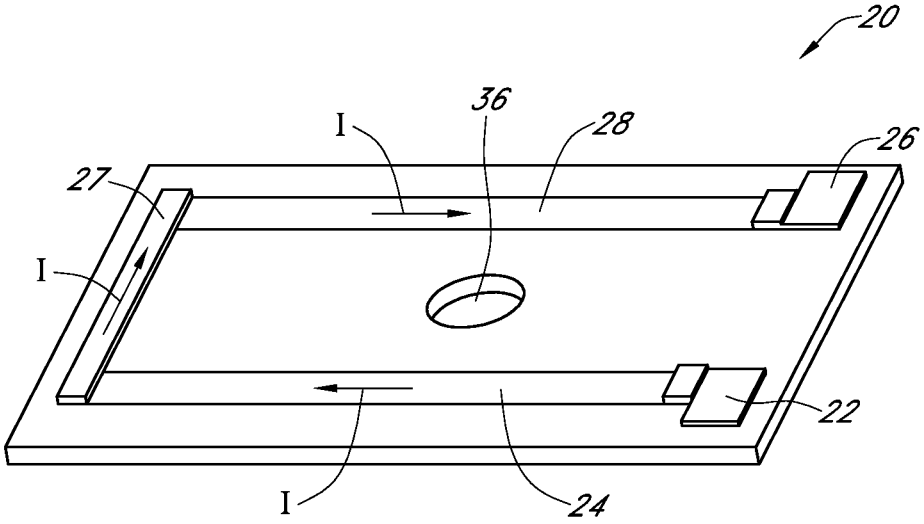
FIG. 2 illustrates a perspective view of one embodiment of a heater adapted for use with the heating device in FIG. 1.

FIG. 2 illustrates a perspective view of a heater 20 adapted for use in a heating device 10 such as the one discussed herein with reference to FIG. 1. In some embodiments, the heater 20 is a thick-film resistance heater or another type of resistive-type heater. Alternatively, a heating device 10 can comprise one or more other types of heaters configured to generate the desired amount of heat. In the depicted embodiment, the heater 20 comprises an electrical input 22 and output 26. As discussed herein with reference to FIG. 1, such inputs and outputs 22, 26 can be selectively connected to a connector 40 or other component that may be easily attached to and detached from a power source.

With continued reference to FIG. 2, the heater 20 can comprise electrical buses 24, 27, 28 or other electrical conducting strips or members that extend along its upper and/or lower surfaces. In some arrangements, electrical current is supplied to the buses 24, 27, 28 or other conducting strips through inputs 22, 26 or other electrical leads. Thus, electrical current (generally represented in FIG. 2 by arrows I) can flow through the buses 24, 27, 28. As electrical current flows through the heater 20, electrical energy can be advantageously converted to thermal energy, thereby generating a desired heating effect along the surface of the heater 10. With reference back to FIG. 1, at least a fraction of such generated heat can be transmitted to and dissipated through fins 54, 64 of the heat transfer assemblies 50, 60, thereby allowing heat to transfer to the air or other fluid being conveyed through the heating device 10.

In other embodiments, the heater 20 comprises one or more resistive materials (e.g., wires, conductive strips, etc.) that are configured to conduct electrical current therethrough, either in addition to or in lieu of electrical buses 24, 27, 28. The position, spacing and general orientation of such conductive materials along the heater 20 surface can be customized to achieve a desired heating effect.

The heater 20 can comprise a ceramic (and/or other electrically non-conducting) base and one or more conductive portions (e.g., steel, copper, other metals, other electrically conductive materials, etc.) for conducting current therethrough. However, the heater 20 can include one or more other non-conductive and/or conductive materials, as desired or required. For example, in some embodiments, the heater 20 includes an electrical isolation layer (e.g., non-electrically conductive layer) and/or a protective coating. In other arrangements, the heater 20 comprises one or more materials having a high thermal conductivity and low electrical conductivity, such as, for example, certain ceramic materials and/or polymer resins. Such thermally conductive materials can help distribute the heat generated at the surface of the heater 20 more evenly. In one arrangement, the thermally conductive material comprises a ceramic, polyimide, epoxy, other polymers and/or the like.

With further reference to FIG. 2, heat can be generated on either or both surfaces. In some embodiments, thermal conductance is generally uniform on both sides of the heater 20. However, in alternative embodiments, thermal conductance is greater on one side than the other, as desired or required by a particular application or use. As discussed in greater detail herein, heat transfer members (e.g., fins) can be positioned adjacent to one or both surfaces to help convey the heat away from the heater 20. This can allow a heating device 10 to more effectively heat a volume of air or other fluid via convection. In addition, transferring heat away from the heater 20 can enhance the function of the heater 20 (e.g., improve its efficiency, extend its useful life, etc.).

In some embodiments, as illustrated in FIG. 2, the heater 20 includes one or more openings 36 through which a bolt, screw or other fastener may be positioned. Such openings 36 can be used to help secure the heater 10 to adjacent fins 50, 60 (or other heat transfer members), a housing 14 and/or other components or portions of the heating device 10. This may be helpful when the heating device comprises materials that cannot be attached to one another using other connection methods or devices, such as, for example, adhesives, welds, heat bonding, etc. As discussed in greater detail herein, one or more other connection methods or devices can be used to attach the various components of the heating device 10 to each other.

FIGS. 3-6 illustrate different views of a heat transfer assembly 150 for use in a heating system as disclosed herein. As shown, the heat transfer assembly 150 can include a base 152 and a plurality of fins 154 or other heat transfer members that generally extend from the base 152. The base 152 and the fins 154 can comprise a unitary structure. Alternatively, the base 152 and the fins 154 can be separate members that are secured to each other using one or more attachment devices or methods (e.g., welds, adhesives, bolts, other fasteners, etc.). The heat transfer assembly 150 can comprise copper, aluminum, other metals or alloys, ceramic and/or any other material, especially those having favorable heat transfer properties.

In the arrangement depicted in FIGS. 3-6, the heat transfer assembly 150 comprises a total of twenty vertically-oriented, parallel fins 154 or other heat transfer members. Thus, as shown, adjacent fins 154 can define a plurality of generally rectangular areas or spaces 151 through which air or other fluids can pass in order to be convectively heated. In other embodiments, however, the quantity, shape, size, orientation, spacing and/or other details of the base 152, fins 154 and/or any other component or feature of the heat transfer assembly 150 can be different than discussed or illustrated herein.

Figure 3:
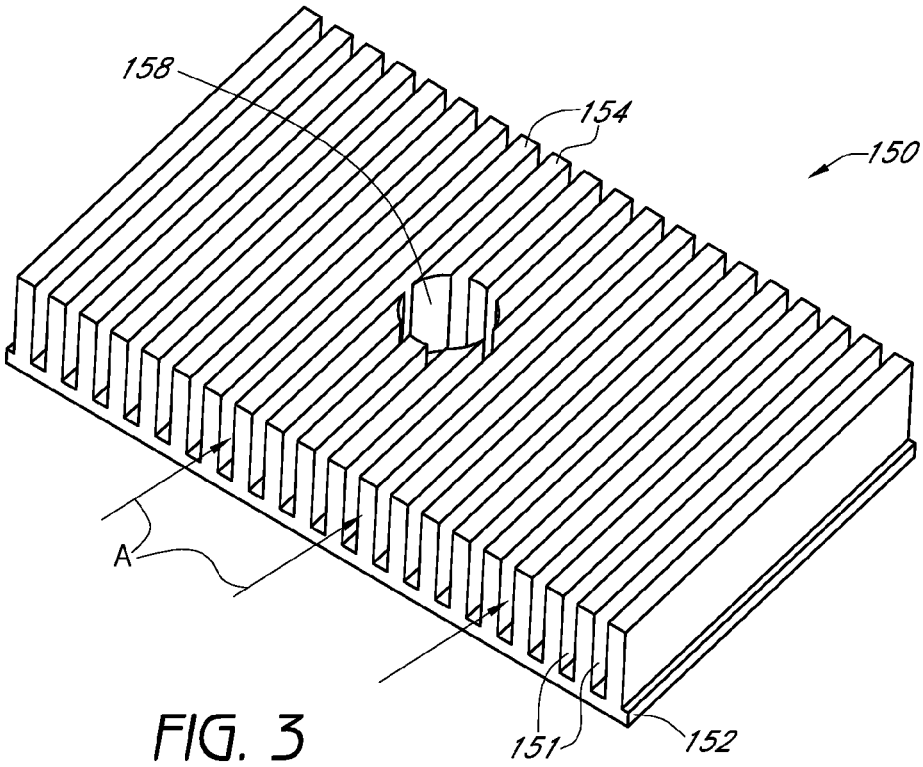
FIG. 3 illustrates a perspective view of one embodiment of a heat transfer assembly adapted for use with the heating device of FIG. 1.
Figure 4:
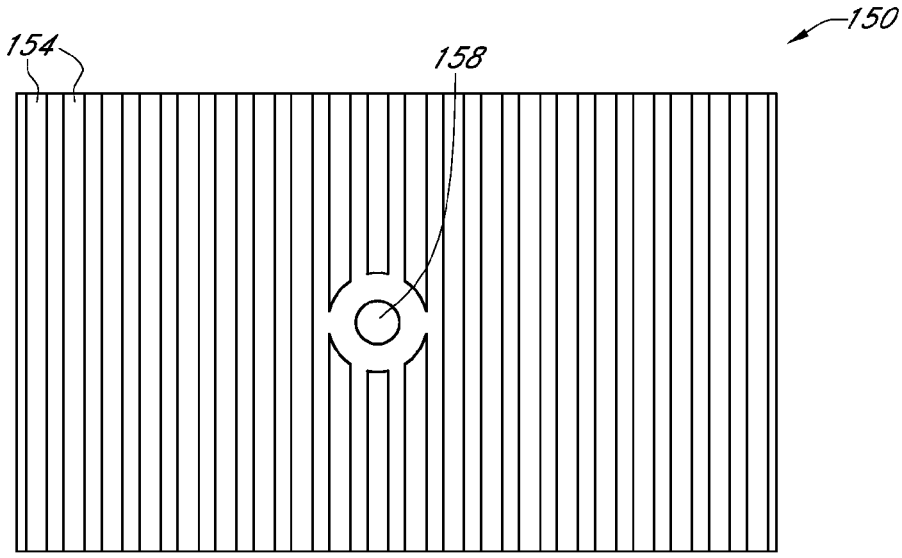
FIG. 4 illustrates a top view of the heat transfer assembly of FIG. 3.
Figure 5:
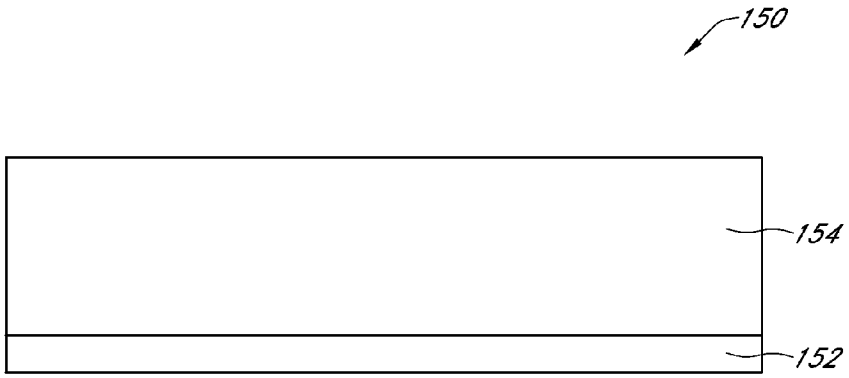
FIG. 5 illustrates a first side view of the heat transfer assembly of FIG. 3.
Figure 6:
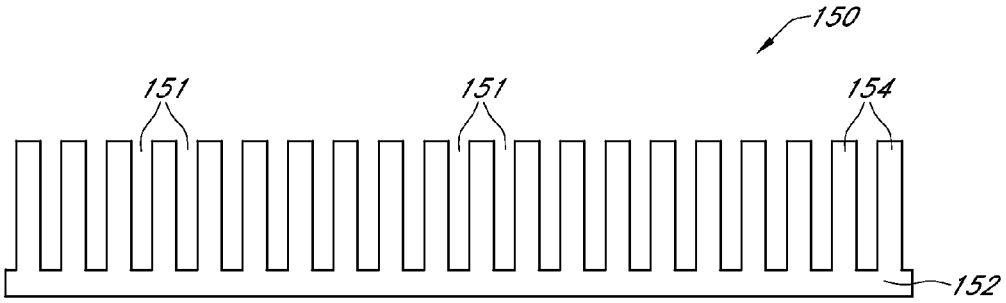
FIG. 6 illustrates a front view or a second side view of the heat transfer assembly of FIG. 3.

As illustrated in FIGS. 3 and 4, the heat transfer assembly 150 can include one or more openings 158 through which a bolt, screw and/or other fastener may be placed. In the depicted embodiment, the heat transfer assembly 150 comprises a single opening 158 which is located near the center of the assembly 150 and which includes a generally circular shape. The opening 158 can be sized, shaped, located and otherwise configured to align and match with corresponding openings of the heater (FIG. 2), another heat transfer assembly, the housing and/or another component of the heating device to which it is secured. Accordingly, a bolt, screw, other fastener or other device may be passed through the openings of various components to secure such components to each other. The quantity, size, shape, location, spacing and/or other characteristics of the openings can be different than disclosed herein, as desired or required.

Figure 7A:
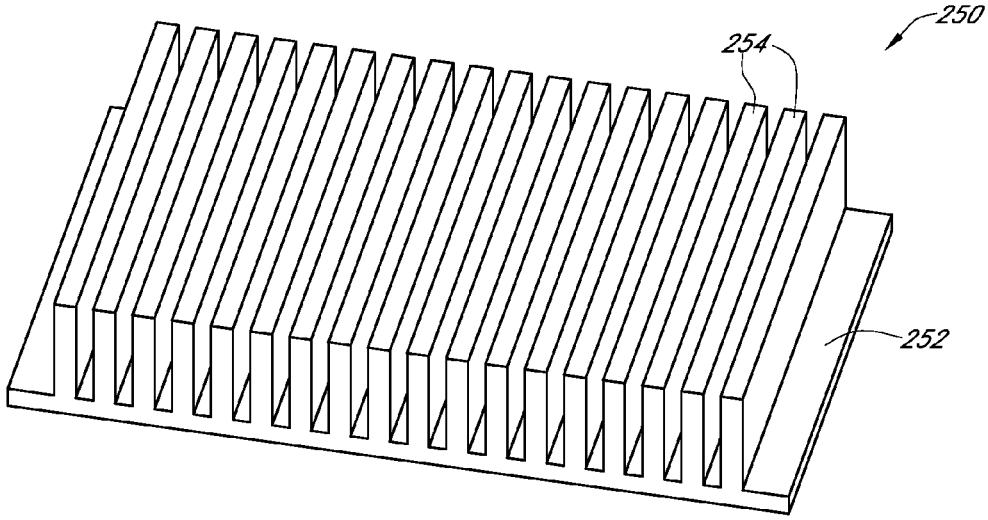
FIG. 7A illustrates a perspective view of a heat transfer assembly according to another embodiment.
Figure 7B:
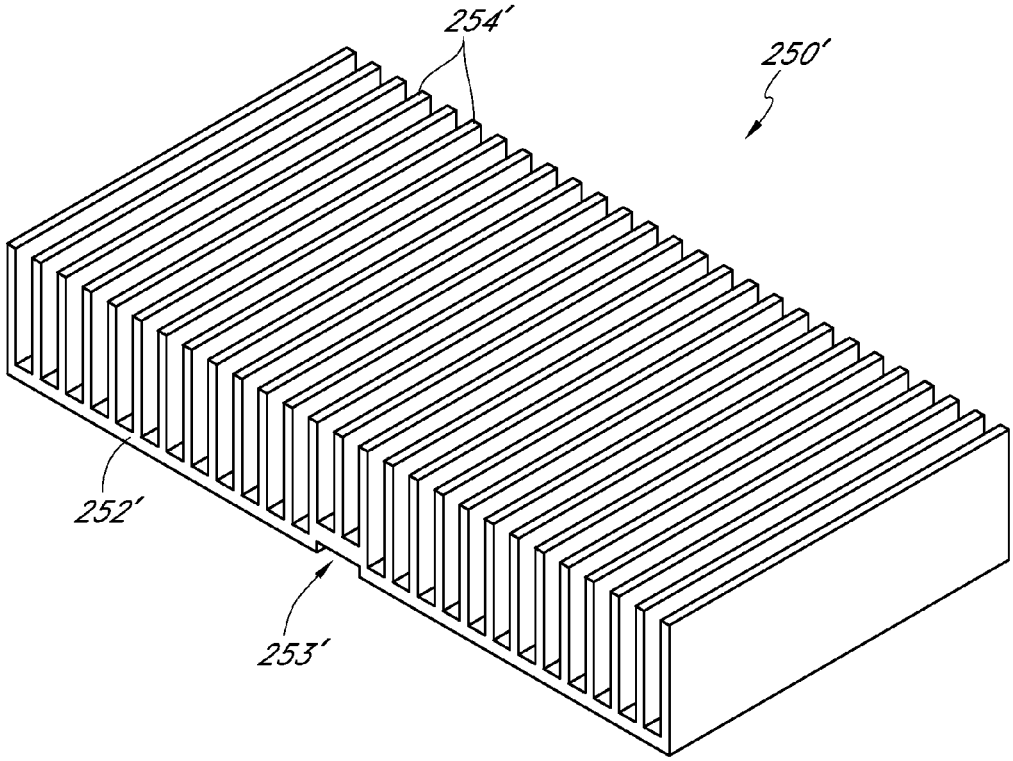
FIG. 7B illustrates a perspective view a heat transfer assembly according to another embodiment.

Another embodiment of a heat transfer assembly 250 is illustrated in FIG. 7A. The depicted heat transfer assembly 250 is similar to the one of FIGS. 3-6 in that it includes a base 252 and a plurality of fins 254 or other heat transfer members extending therefrom. However, unlike the arrangement shown in FIGS. 3-6, the depicted assembly 250 does not include an opening. Thus, the heater, one or more heat transfer assemblies 250 and/or any other components of the corresponding heating system can be secured to each other using different connection devices or methods, such as, for example, welds, adhesives, thermal grease, clips and/or like. Alternatively, in any of the embodiments of a heating device disclosed herein, the heater, heat transfer assemblies and/or any other components can be maintained in a desired orientation relative to each other (e.g., connected to each other, in contact with each other, etc.) without the use of adhesives, fasteners and/or other connection devices. For example, in such arrangements, the various components of the heating devices can be configured to mechanically fit within a polymeric or other type of outer housing. A similar embodiment of a heat transfer assembly 250' is illustrated in FIG. 7B. The assembly 250' can include a plurality of heat transfer members 254' extending from a base 252'. As shown in FIG. 7B, the assembly 250' can include a cutout, recess or similar feature along the base to advantageously accommodate a thermistor, sensor and/or any other component or item that may be included in a heating device.

Figure 8:
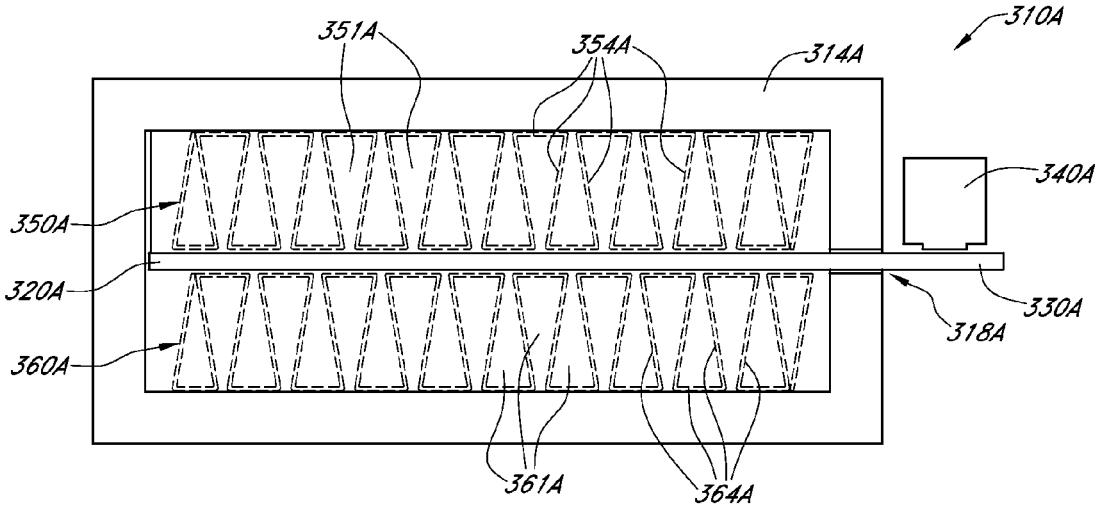
FIG. 8 illustrates a front view of a heating device comprising upper and lower heat transfer assemblies according to one embodiment.

FIG. 8 illustrates a front view of a heating device 310A according to one embodiment. The heating device 310A can include an outer housing 314A that generally surrounds a heater 320A, upper and lower heat transfer assemblies 350A, 360A and/or any other component. As discussed, the heat transfer assemblies 350A, 360A can be secured to the heater 320A using one or more attachment devices or methods. Alternatively, the assemblies 350A, 360A can be configured to be in thermal communication with the heater without physically contacting it. For example, the heat transfer assemblies 350A, 360A can be placed in close proximity to the heater 320A with one or more intermediate members (e.g., a polyimide or other thermally-conductive layer, heat distribution component, etc.) situated between the heater 320A and the heat transfer assemblies 350A, 360A. The heater 320A can comprise a thick-film heater, another type of restive heater and/or any other type of device configured to selectively produce thermal energy.

Further, as discussed herein with reference to the embodiment of FIG. 1, the heater 320A can comprise a protruding portion 330A that generally extends to the exterior of the housing 314A. As shown in FIG. 8, the housing 314A can include a slot 318A or other opening through which the protruding portion 330A can exit the interior of the device 310A. In some embodiments, a connector 340A secured to the protruding portion 330A of the heater 320A allows a user to easily attach or detach the heating device 310A to or from a power source (e.g., a vehicle's electrical system, a battery, another AC or DC power source, etc.) and/or other electrical component (e.g., processor, sensor, controller, another heating device, etc.).

Figure 9:
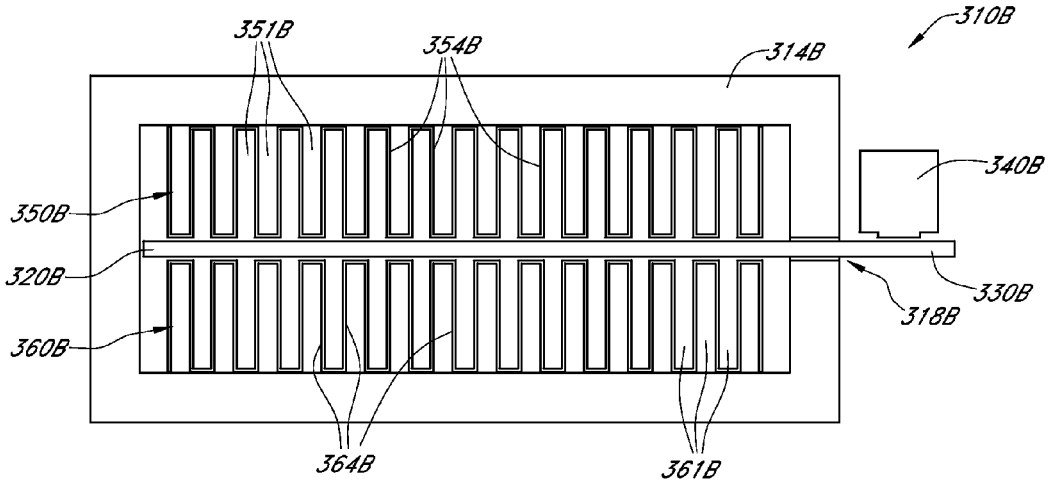
FIG. 9 illustrates a front view of a heating device comprising upper and lower heat transfer assemblies according to another embodiment.

With continued reference to FIG. 8, the fins 354A, 364A of the heat transfer assemblies 350A, 360A can have a folded design. The fins 354A, 364A can be folded in a manner that creates alternating upper and lower portions that are flat or substantially flat. In some arrangements, heat can be transferred from the heater 320A to the heat transfer assemblies 350A, 360A primarily through these flat or substantially flat portions of fins 354A, 364A. As shown in FIG. 8, the fins 354A, 364A can foam generally triangular or trapezoidal spaces 351A, 361A or gaps between adjacent folds through which air or other fluids may pass. An alternative arrangement of heat transfer assemblies 350B, 360B is illustrated in FIG. 9. In the depicted embodiment, adjacent folded fins 354B, 364B of the assemblies 350B, 360B are generally parallel to each other (e.g., the fins have more of a vertical orientation). Accordingly, the spaces 351B, 361B or gaps between adjacent fins 354B, 364B comprise a generally rectangular shape. In other arrangements, the heat transfer assemblies can have a different shape, size, spacing, orientation and/or other characteristics, as desired or required.

Figure 10:
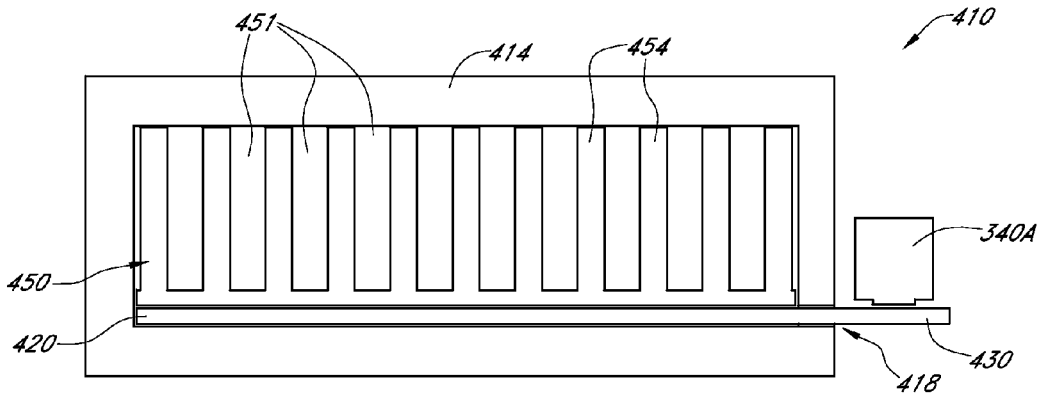
FIG. 10 illustrates a front view of a heating device comprising an upper heat transfer assembly according to one embodiment.

FIG. 10 illustrates an embodiment of a heating device 410 comprising a heat transfer assembly 450 positioned on only one side of the heater 420. As shown, the heater 420, the heat transfer assembly 450 and an outer housing 414 positioned therearound can define a plurality of spaces 451 through which air or other fluids can be selectively directed. Consequently, air or other fluids passing through the heating device 410 can be thermally conditioned (e.g., heated) by convective heat transfer. Such heated air or other fluids can be subsequently delivered to one or more portions of a climate-controlled seating assembly (e.g., vehicle seat, other chair, bed, etc.) or other device. In other embodiments, the size, shape, orientation, spacing and/or other details of the heat transfer assembly 450 are different than illustrated and discussed herein. For example, the fins 454 or other heat transfer member can include a folded design, such as those shown in FIGS. 8 and 9. In certain arrangements, the spaces 451 between adjacent fins 454 can include a different size, shape and/or the like. For example, the spaces 451 can be customized to achieve a desired flow pattern or characteristics (e.g., laminar, turbulent, etc.) or to meet certain design criteria (e.g., maximum or desired headloss for a given flowrate, maximum or desired noise requirements, etc.) through the heating device 410.

According to some embodiments, electrical current is delivered to a heater of a heating device through wires that are connected to an exterior portion of the device's housing. For example, the wires can be secured to the housing corresponding attachment assemblies. Such attachment assemblies can include electrically conductive pins and electrically conductive brackets that allow electricity to be transferred between the wires and the leads of the heater. In some embodiments, the brackets are also be used to structurally secure a heater relative to the housing. The wires of such a device can be connected to a power supply (e.g., a vehicle's electrical system, a battery, another AC or DC power source, solar panel, etc.). Consequently, the heater can be selectively energized by delivering electrical current to it in order to create a desired heating effect along the adjacent heat transfer assemblies. As a result, air or other fluids passing through the heating device can be convectively heated. In alternative arrangements, electrical current can be supplied to the heater in a different manner than illustrated or described herein.

Figure 11A:
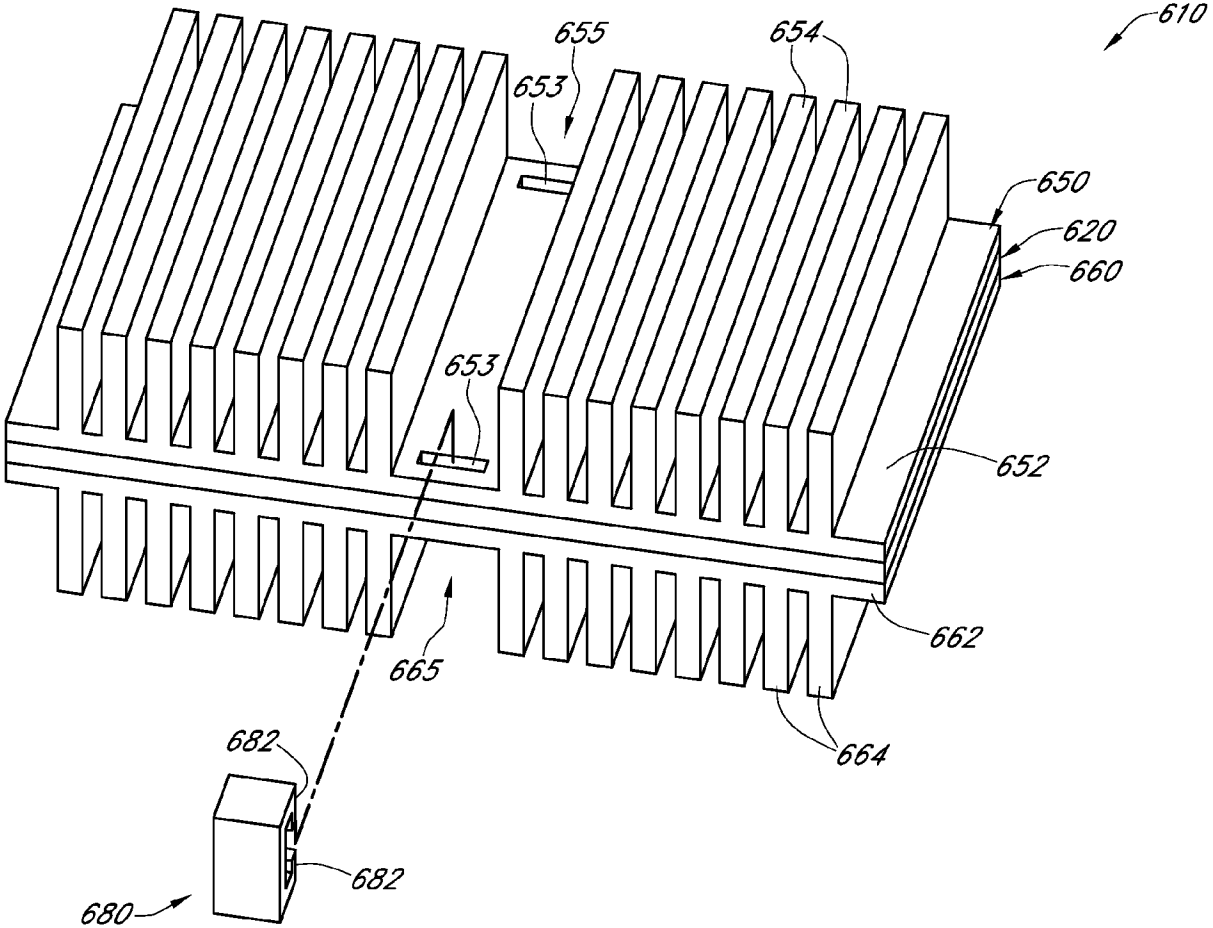
FIGS. 11A and 11B illustrate perspective views of a heating device comprising a heater and adjacent heat transfer assemblies held together by clips or other fasteners according to one embodiment.
Figure 11B:
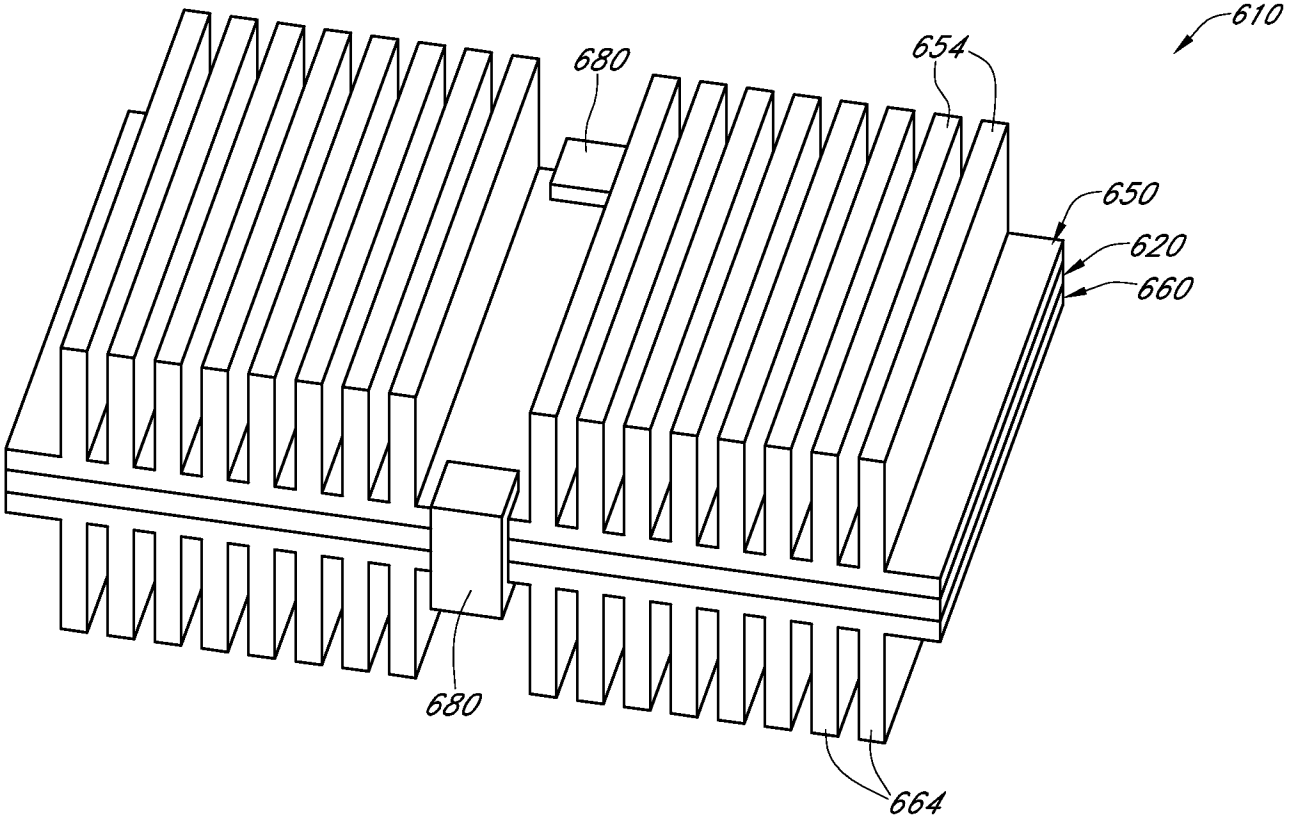

FIGS. 11A and 11B illustrate perspective views of a heating device 610 that includes a heater 620 and heat transfer assemblies 650, 660 positioned immediately above and below the heater 620. In the depicted embodiment, each heat transfer assembly 650, 660 comprises a middle portion 655, 665 that does not include fins 654, 664 or other heat transfer members. As shown, such fin-free portions 655, 665 can include slots 653 or other engagement features (e.g., recesses, other openings, protrusions, flanges, tabs, etc.) to help secure a clip 680, other mechanical fastener and/or other attachment device thereto. In some embodiments, the middle portion 655, 665 of each heat transfer assembly 650, 660 includes two or more slots 653 located near the edge of the base 652, 662 of the respective assembly 650, 660. The quantity, shape, size, location along the heat transfer assembly, spacing and/or other details of the fin-free portions 655, 665, slots 653 or other engagement members, clips 680 and/or any other component or feature of the heating device 610 can be varied, as desired or required. For instance, the fin-free portion 655, 665 of the heat transfer assemblies 650, 660 can be positioned along any other area of the assemblies 650, 660, including, without limitation, the edges, areas between the middle and the edges and/or the like. In addition, a heat transfer assembly 650, 660 can include two or more different portions or areas which do not include fins and which are configured to receive a clip 680 or other securement device.

With continued reference to FIGS. 11A and 11B, clips 680 can be used to secure the heater 620 to the adjacent heat transfer assemblies 650, 660. In the depicted embodiment, one clip 680 is positioned on either end of the fin-free regions 655, 665 of the heat transfer assemblies 650, 660. However, as noted above, a heating device 610 can include more or fewer clips 680. In other arrangements, a different connection method or device can be used to permanently or removably (e.g., temporarily) attach the various components of the heating device 610 to each other, either in lieu of or in addition to clips 680 or other mechanical fasteners. For example, the heat transfer assemblies 650, 660, the heater 620, the housing (not shown in FIGS. 11A and 11B) and/or any other component or feature can be secured to each other using welds, rivets, bolts, screws, other fasteners, adhesives and/or the like.

As shown in FIG. 11A, the clips 680 can include a flanged portion 682 that is shaped, sized and otherwise adapted to fit within a corresponding slot 653 of the upper or lower heat transfer assembly 650, 660. In some embodiments, the clips 680 comprise one or more rigid, semi-rigid and/or flexible materials that are adapted to withstand the forces, stresses, temperature variations and/or other elements to which they may be exposed. For instance, the clips 680 can comprise plastic or other polymeric materials, metals or other alloys, paper or wood-based materials and/or the like. In certain arrangements, the clips 680 are resilient so they may be easily secured to or removed from the device 610, as desired or required.

Figure 12:
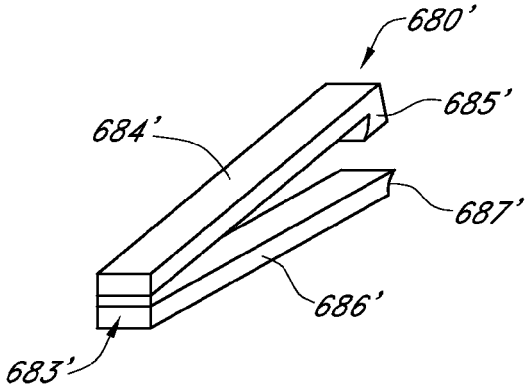
FIG. 12 illustrates a clip configured to secure various components of a heating device to each other according to another embodiment.

FIG. 12 illustrates another embodiment of a clip 680' adapted to secure heat transfer assemblies and/or other components of a heating device to a heater (not shown). For example, such a clip 680' can be sized, shaped and otherwise configured to be positioned within a fin-free portion 655, 665 of a heat transfer assembly 650, 660 (FIG. 11A). In other embodiments, such a clip 680' is adapted to fit between adjacent fins 654, 664 or other heat transfer members.

With continued reference to FIG. 12, the clip 680' can include upper and lower portions 684', 686' that are attached to each other using a hinge 683' or other movable connection. Thus, such a hinge 683' can advantageously permit the upper and lower portions 684', 686' to be moved relative to each other in order to secure the clip 680' to (or remove it from) a heating device. As shown, one of the upper and lower portions 684', 686' can include an engagement feature 685' configured to engage and secure to a corresponding area or feature 687' (e.g., recess) of the opposite portion 684', 686'. Accordingly, the upper and lower portions 684', 686' can be selectively brought together or moved apart in order to secure the clip 680' to a heating device.

Figure 13A:
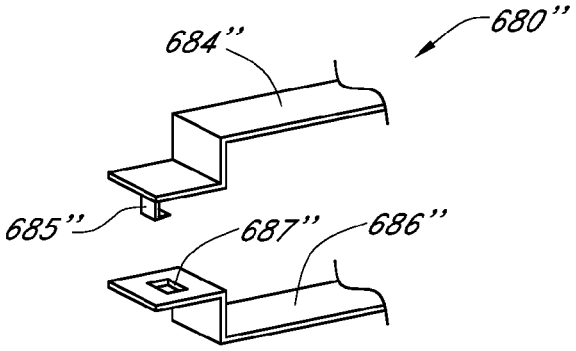
FIG. 13A illustrates a clip configured to secure various components of a heating device to each other according to still another embodiment.
Figure 13B:
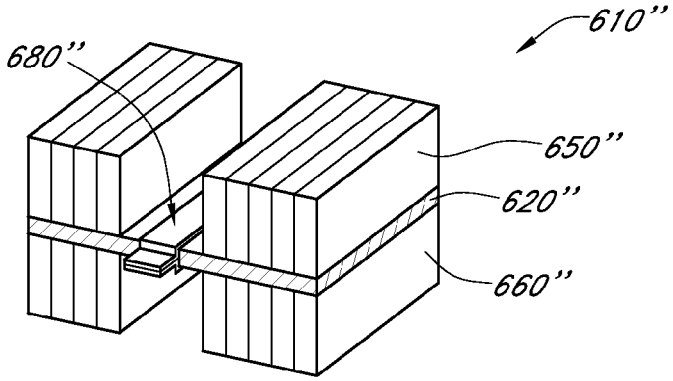
FIG. 13B illustrates the clip of FIG. 13A positioned on a heating device.

Another embodiment of a clip 680" for securing the heat transfer assemblies 650", 660" and/or other components of a heating device 610" to a heater 620" is illustrated in FIGS. 13A and 13B. As with the arrangement disclosed herein with reference to FIG. 12, the depicted clip 680" can include upper and lower portions 684", 686" that may be selectively attached to or removed from each other. For example, in FIG. 13A, the upper portion 684" includes an engagement tab 685" or other protrusion that is configured to fit within and secure to a slot 687" or other opening of the lower portion 686". In other embodiments, the upper and lower portions 684", 686" are configured to secure to each other using one or more other devices or features. FIG. 13B is a perspective view of a heating device 610" comprising a clip 680" adapted to maintain the various components of the device secured to one another.

Figure 14:
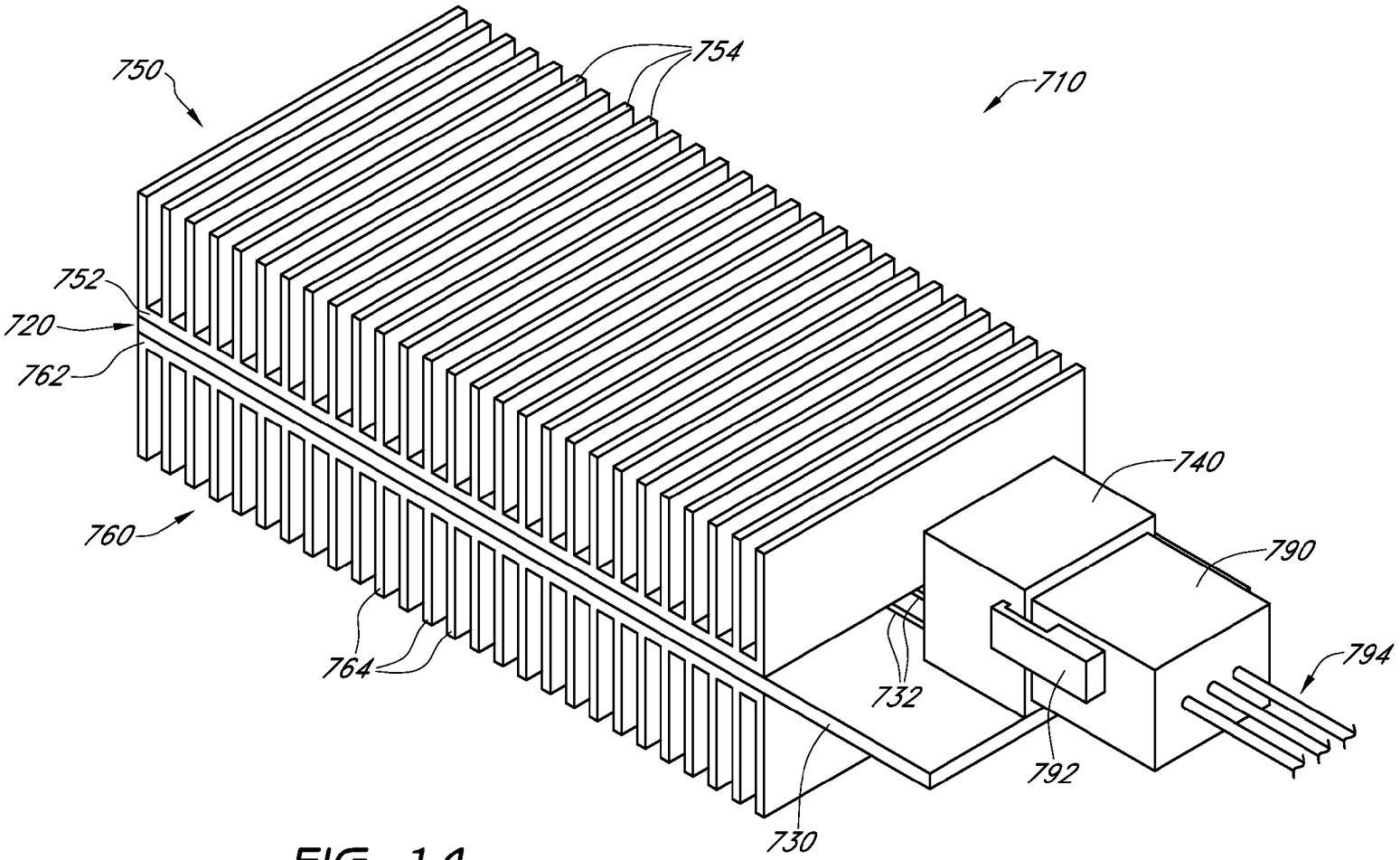
FIG. 14 illustrates a perspective view of a heating device attached to a power coupling according to one embodiment.

FIG. 14 illustrates a perspective view of a heating device 710 according to one embodiment. As shown, the heating device 710 can include a heater 720 generally positioned between upper and lower heat transfer assemblies 750, 760. As discussed herein with reference to other arrangements, each heat transfer assembly 750, 760 can include a plurality of fins 754, 764 between which air or other fluids may be selectively directed for thermal conditioning. The heat transfer assemblies 750, 760 can be secured to the heater 720 using one or more attachment devices or methods, such as, for example, clips, bolts, screws or other fasteners, adhesives, adhesive tapes, welds, rivets and/or the like.

According to certain embodiments, the dimensions of each heat transfer assembly 750, 760 are approximately 54.1 mm long, 32.7 mm wide and 9.2 mm high. However, in other arrangements, the size, dimensions, shape and/or other characteristics of a heat transfer assembly 750, 760 can vary, as desired or required by a particular application or use. The base 752, 762, fins 754, 764 or other heat transfer members and/or any other component of the heat transfer assembly 750, 760 can comprise one or more metals (e.g., copper, aluminum, etc.), alloys, ceramics and/or any other material, especially those having favorable or desired heat transfer characteristics.

As discussed in greater detail herein, the heater 720 can include a thick-film heater, a thin-film heater, another resistance-type heater, one or more electrically conductive layers (e.g., sprayed layers, dip coated layers, etc.) and/or any other device adapted to produce heat. In addition, as with any of the embodiments illustrated or otherwise disclosed herein, or equivalents thereof, one or more materials can be positioned between the heater 720 and the adjacent heat transfer assemblies 750, 760 to facilitate the distribution and transfer of heat. For example, thermal adhesive, thermal epoxy, thermal grease, thermal paste, and/or other thermal compounds known in the art may be used.

With continued reference to FIG. 14, the heater 720 can include a protruding portion 730 that generally extends beyond the periphery or outer edges of the upper and lower heat transfer assemblies 750, 760. In certain embodiments, such as the one discussed herein in relation to the device of FIG. 1, the protruding portion 730 can include one or more connectors 740 that are used to easily connect or disconnect the device 710 to or from a power source (e.g., an automobile's electrical system, battery, another AC or DC power source, etc.). Further, the connector 740 can place the heating device 710 in data communication with a controller, processor or other electrical device, as desired or required.

The connector 740 can be permanently or removably attached to the protruding portion 730 of the heater 720 using one or more connection methods or devices, such as, for example, adhesives, tapes, welds, fasteners and/or the like. Regardless of the exact configuration and other details of the heating device 710, the electrical leads 732 of the heater 720 can advantageously terminate at the connector 740 to selectively energize the heater 720 when the connector 740 is attached to an active power supply.

With continued reference to the embodiment depicted in FIG. 14, the connector 740 can include a recess 742 or other opening which is sized, shaped and otherwise adapted to receive a corresponding power coupling 790. The coupling 790 can be connected to one or more wires 794 that are configured to provide electrical current to the heater 720 (e.g., from an AC or DC power source) and/or to place the heating device 710 in data and/or electrical communication with another component (e.g., controller, processor, sensor, etc.). As shown in FIG. 14, the coupling 790 can be connected to the device 710 using a movable tab 792 or other member or feature (e.g., clips, other engagement features, friction fittings, threaded connection, etc.) that is configured to engage and secure to a corresponding portion of the connector 740. For instance, the movable tab 792 can be lifted in order to secure the coupling 790 to the connector 740. In one embodiment, once the tab 792 is released, the coupling 790 is advantageously locked to the coupling 740. Likewise, the tab 792 may need to be lifted in order to separate the coupling 790 from the connector 740. One or more other devices, features and/or methods can be used to place the connector 740 or other portion of the heater 720 in electrical communication with a power supply and/or other electrical component.

Accordingly, once the heating device 710 has been properly connected to an energized coupling 790 and electrical current has been delivered to the heater 720, the fins 754, 764 or other heat transfer members of the adjacent assemblies 750, 760 can be selectively heated. Thus, air or other fluids passing through the heating device 710, which in some embodiments includes an outer housing (not shown in FIG. 14), can be thermally conditioned before being conveyed to a desired location (e.g., a vehicle seat, a bed, another type of climate controlled seat assembly, another device, region or area, etc.). The amount of heat that is transferred to the fins 754, 764, and ultimately to the air or other fluid passing therethrough, can be controlled by, among other things, regulating the amount of electrical current being delivered to the heater 720, the flowrate of air passing through the heater, the types of materials used in the heating device, the insulation properties of the device; the type of heater used and/or any other variables.

Figure 15A:
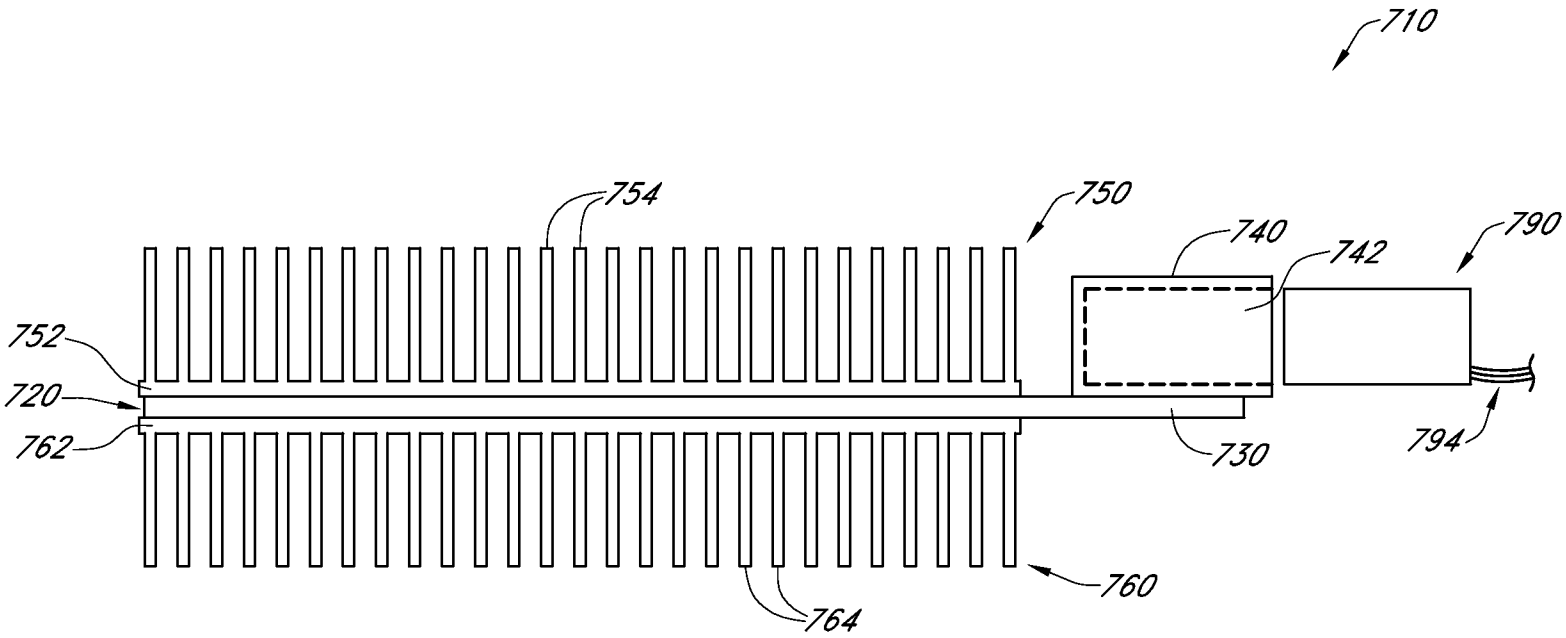
FIG. 15A illustrates a front view of the heating device of FIG. 14.

FIG. 15A is a front elevation view of a heating device 710 similar to the one illustrated and discussed herein with reference to FIG. 14. As shown, the device 710 can include a heater 720 generally positioned between upper and lower heat transfer assemblies 750, 760. In addition, a protruding portion 730 of the heater 720 can include a connector 740 that is configured to be selectively coupled to or detached from a power coupling 790.

Figure 15B:
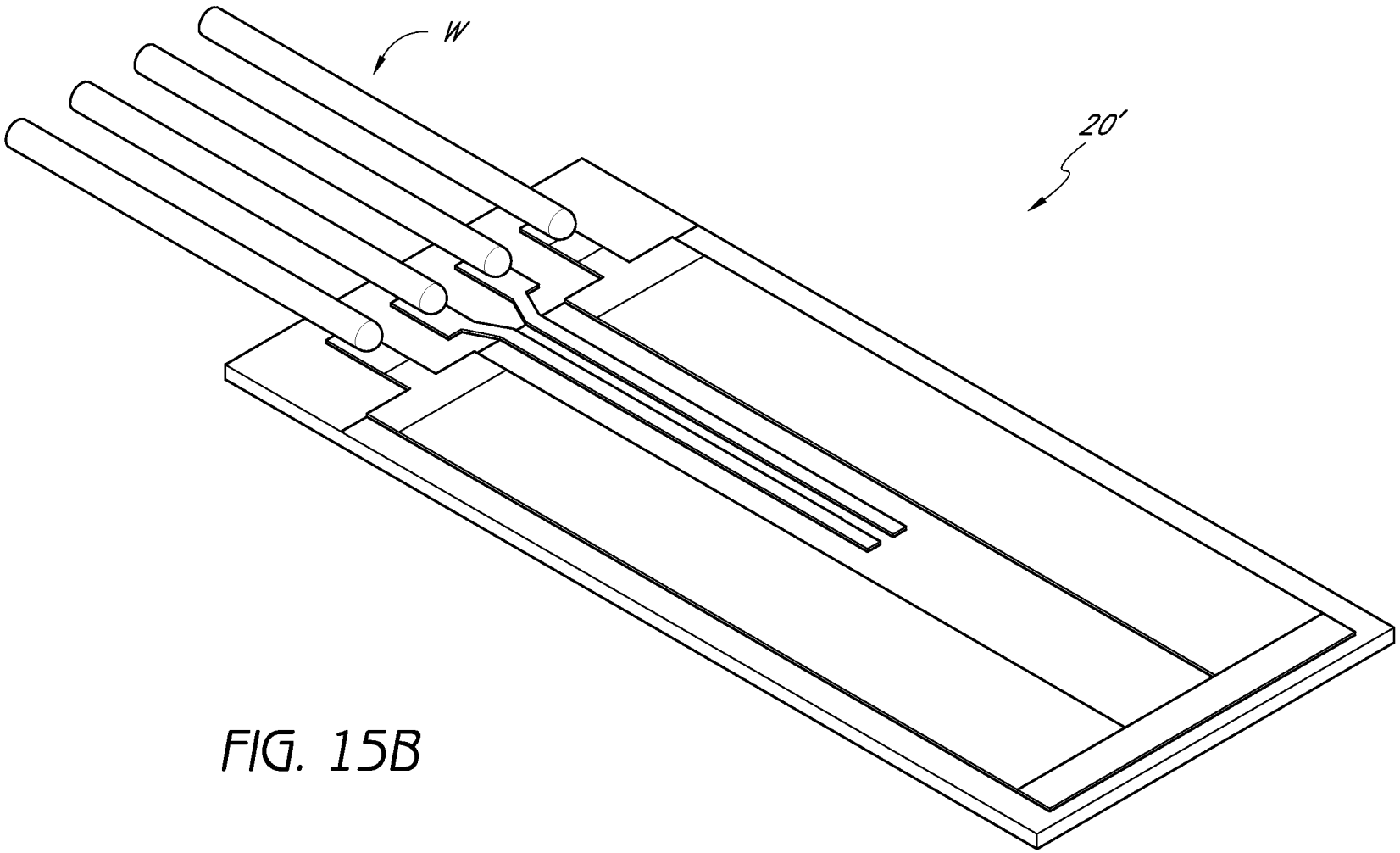
FIG. 15B illustrates a perspective view of one embodiment of a heater configured to connect to an power source and/or another electrical component using a plurality of lead wires.

As illustrated in FIG. 15B, for any of the embodiments of a heating device disclosed herein, or equivalents thereof, the heater 20' can include one or more lead wires W that are configured to place the heating device in electrical and/or data communication with a power source and/or another electrical component. Such lead wires W can be used either in lieu of or in addition to a coupling, such as the connector illustrated in FIG. 15A.

Figure 16A:
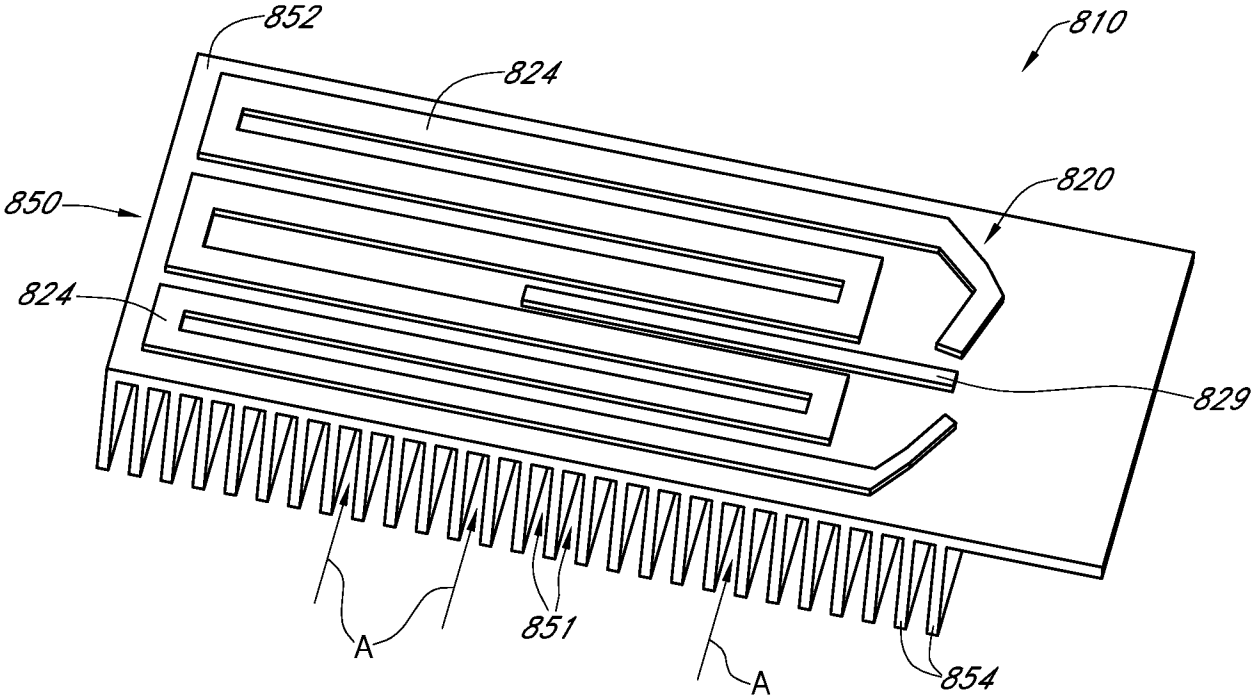
FIG. 16A illustrates a perspective view of a heating device wherein the heater is incorporated onto a base of the heat transfer assembly according to one embodiment.

A perspective view of another embodiment of a heating device 810 is illustrated in FIG. 16A. The depicted heating device 810 generally incorporates the heater 820 and the heat transfer assembly 850 into a unitary structure. For example, the heating device 810 can comprise a single heat transfer assembly 850 that includes a base 852 and a plurality of fins 854 or other heat transfer members extending from a first surface of the base. In other arrangements, the shape, size, spacing or other characteristics of the fins 854 and/or other components of the assembly 850 can vary, as desired or required.

With continued reference to FIG. 16A, the various components of the heater 820 can be positioned along or incorporated onto the heat transfer assembly 850. For example, as shown, the conductive leads 824, the thermistor 829 and/or the like can be situated along the base 852 of the assembly, generally along the opposite surface of the fins 854 or other heat transfer members. In some embodiments, the electrical leads 824, the thermistor and/or other electrically conductive members can be printed onto the base 852 of the assembly 850 using conductive inks. The size, pattern, material composition and other properties or characteristics of the leads 824 and/or other conductive members can help determine the overall capacity and other performance-related properties of the heater 810. For example, such variables can be modified to provide the device 810 with a desired electrical resistance, total heat output per electrical input and/or the like. In some embodiments, before and/or after depositing the leads 824, thermistor and/or other conductive members on the assembly 850, one or more other layers or coatings can be applied thereto. For example, in one embodiment, an electrical isolation layer is applied to the base 852 of the assembly 850. This can help achieve the desired thermal output, while protecting the heater from potentially dangerous or otherwise unwanted electrical exposure.

Further, an outer wrap or housing (not shown in FIG. 16A) can be provided around the device 810 to enclose the space through which fluids are selectively directed, to provide for thermal insulation, to protect the components of the device 810 and/or for any other purpose. As electrical current is provided through the conductive leads 824 and/or other conductive members of the device 810, a corresponding amount of heat is produced along the heater 820. The heat produced by the heater 820 can be transmitted to the fins 854 or other heat transfer members of the device. Consequently, as discussed with reference to other embodiments disclosed herein, air or other fluids passing through the spaces 851 defined by adjacent fins 854 (e.g., in a direction generally represented by arrows A) can be selectively heated.

Figure 17A:
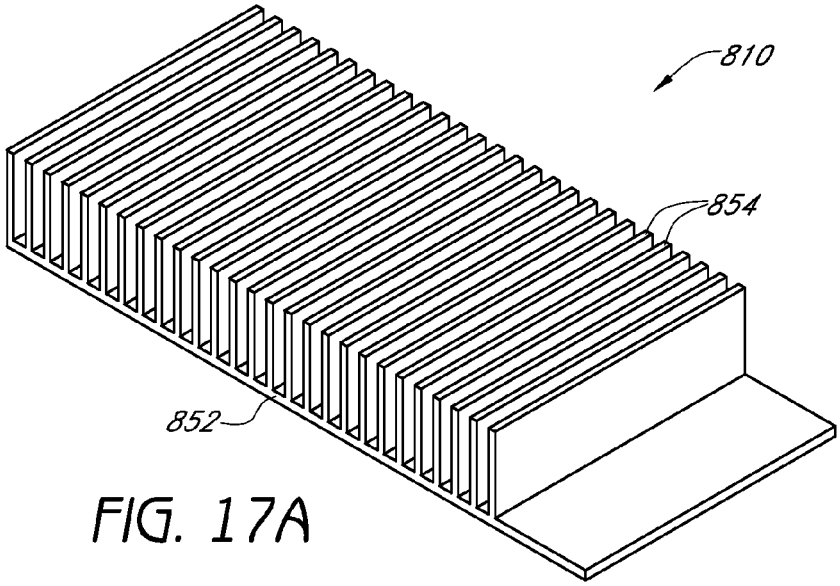
FIG. 17A illustrates a different perspective view of the heating device of FIG. 16A.
Figure 17B:
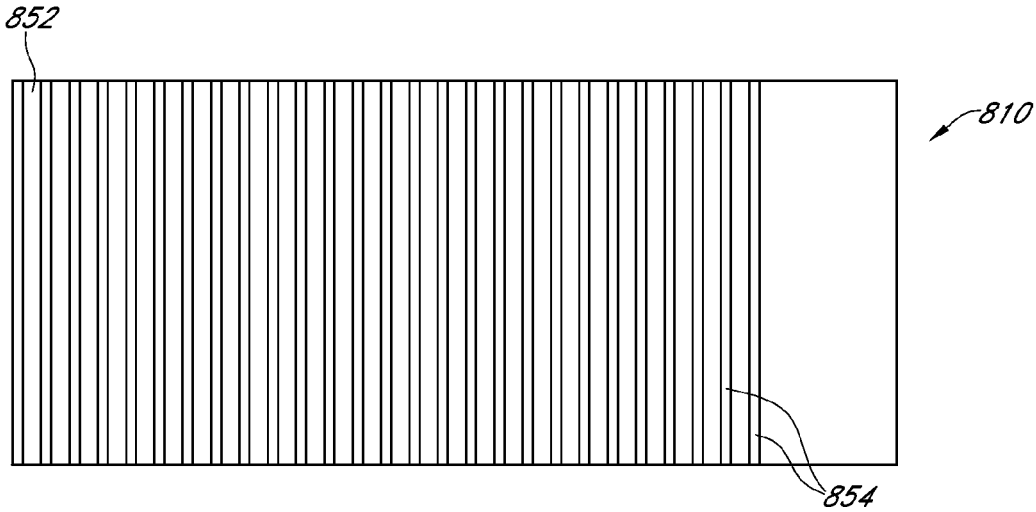
FIG. 17B illustrates a top view of the heating device of FIG. 16A.
Figure 17C:
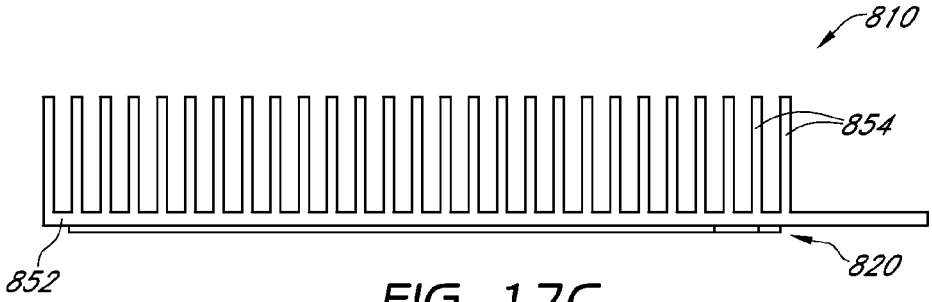
FIG. 17C illustrates a front view of the heating device of FIG. 16A.

The embodiment of FIG. 16A can offer a compact and convenient device for thermally conditioning air or other fluids, as the need for a separate heater and heat transfer assemblies is eliminated. This can be particularly helpful when the heater 810 needs to be designed in accordance with relatively strict size constraints or parameters. In addition, the challenge of connecting the heater to one or more heat transfer assemblies is eliminated in such embodiments. Consequently, the labor, expense and complexity of such heating devices can be advantageously decreased. In addition, such unitary heating devices 810 can offer more reliable and accurate heating of air or other fluids passing therethrough. FIGS. 17A-17C provide different views of the heating device 810 of FIG. 16A.

As noted above, in some embodiments, electrical leads and/or other electrically conductive members can be printed or otherwise formed onto a base of a heat transfer assembly or along any other portion of a heating device using conductive inks that have desired electrically resistive properties. Accordingly, such conductive inks or other materials can be selectively printed or otherwise deposited onto one or more surfaces of a heating device (e.g., a base of a fin assembly or other heat transfer assembly). This can provide a simpler, less expensive and/or faster method of producing a heating device. Such conductive inks and other materials can replace, either partially or completely, the conductive leads, buses or other electrically conductive materials or components of a heating device.

According to some embodiments, one or more electrically conductive layers can be applied along one or more surfaces of a heating device to create the conductive leads or pathways through which electrical current may be routed to selectively produce heat. For example, such materials can be sprayed onto a surface of the heating device. Alternatively, such electrically conductive materials can be applied to one or more surfaces or other portions of a heating device using a dip coating, printing, plating or other process.

Such electrically conductive materials (e.g., inks, layers, etc.) can be sprayed, dip coated, powder coated, screen printed, electroplated and/or otherwise applied (e.g., either directly or indirectly) on a surface of a heating device. In some arrangements, the electrically conductive materials include, without limitation, metals (e.g., silver, copper, alloys, etc.), electrically-conductive graphite or other carbon materials and/or any other electrically-conductive materials.

Figure 16B:
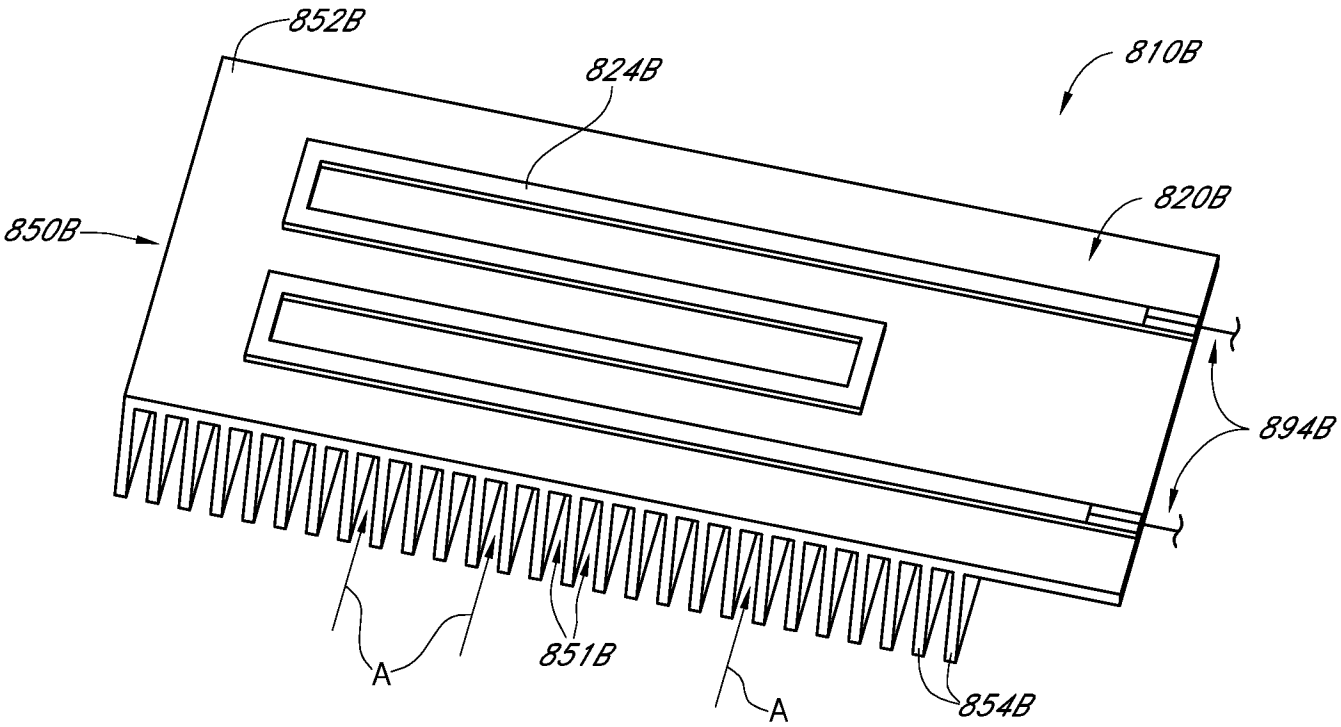
FIG. 16B illustrates a perspective view of another embodiment of a heating device in which the heater and the heat transfer assembly are incorporated into a generally unitary structure.

As illustrated in FIG. 16B, a heating device 810B can include a heat transfer assembly 850B (e.g., fin assembly) having a base 852B that is configured to receive one or more electrically conductive materials along one or more of its surfaces. As noted above, such electrically conductive materials can be positioned onto targeted regions of the base 852B and/or any other surface of the heating device 810B using one or more methods (e.g., spraying, coating, printing, plating, etc.), as desired or required. In the depicted embodiment, electrically conductive materials have been deposited on the base 852B, along a surface generally opposite of the fins 854B, so as to effectively form an electrical pathway 824B through which current may pass. As shown, the ends of the conductive path 824B can be electrically coupled to wires 894B or other members that are connected to a power supply or another electrical component. In other embodiments, the electrically conductive pathway include a different shape or orientation along one or more surfaces of the base 852B and/or other portions of the heating device 810B. For example, the width, length, spacing, location, pattern and/or other characteristics of the path 824B can be different than illustrated in FIG. 16B.

Figure 16C:
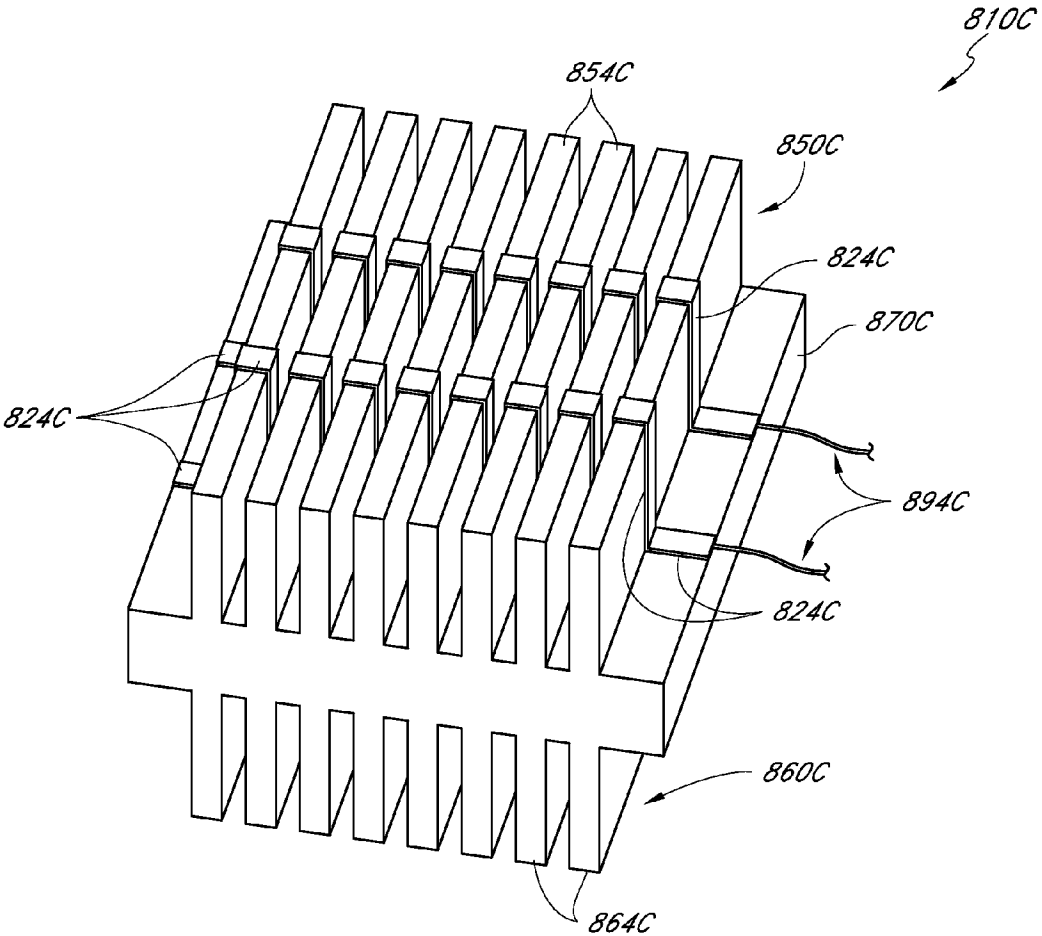
FIG. 16C illustrates a perspective view of another embodiment of a heating device in which the heater and the heat transfer assemblies are incorporated into a generally unitary structure.
Figure 16D:
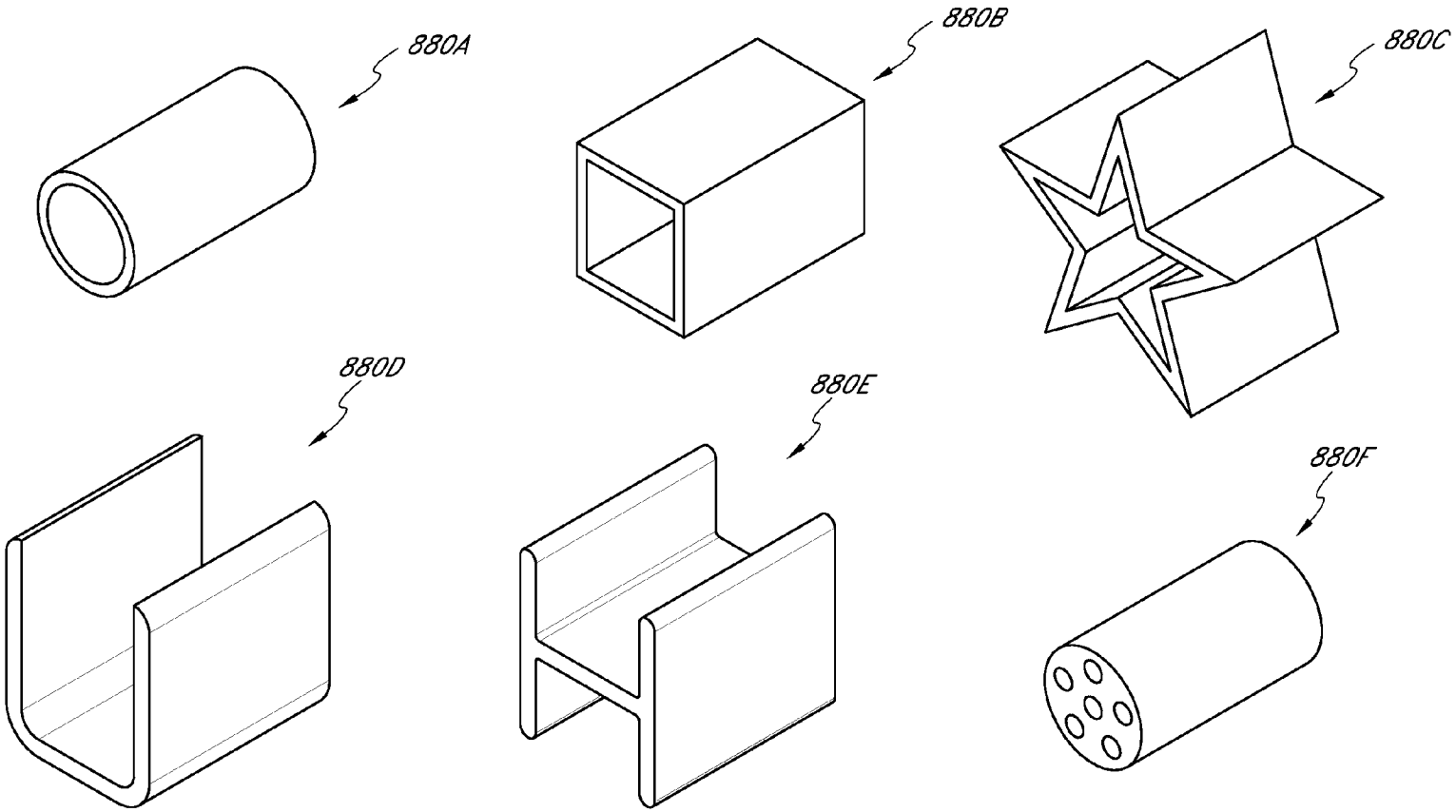
FIG. 16D illustrates various other embodiments of generally electrically non-conductive substrates for use with a heating device.

Another embodiment of a heating device 810C is illustrated in FIG. 16C. As shown, the heating device 810C includes upper and lower heat transfer assemblies 850C, 860C generally positioned between a central base 870C. In some arrangements, the heat transfer assemblies 850C, 860C and the base 870C are formed as a unitary structure. Alternatively, the assemblies 850C, 860C and the base can comprise two or more portions that are permanently or removably secured to each other (or are otherwise maintained in a desired orientation relative to each other).

With continued reference to FIG. 16C, an electrically conductive path 824C can be formed along one or more surfaces of the heating device 810C. For example, in FIG. 16C, the electrical pathways 824C are positioned along both the main base 870C and the fins 854C of the upper heat transfer assembly 850C. In other embodiments, the pathway 824C is positioned along at least some of the fins 864C of the bottom assembly 860C, either in addition to or in lieu of fins of the upper assembly 850C. In still other embodiments, the pathway is routed along larger or smaller (or different) areas of the heating device 810C, as desired or required. Regardless of their exact size, dimensions, location, spacing and/or other details, the electrically conductive pathways comprise one or more materials (e.g., metals, carbon, etc.) that conduct the electrical current provided to a heating device 810C (e.g., via wires 894C, other leads, etc.). Accordingly, heat is advantageously produced along one or more portions of the device 810C. As discussed herein with reference to other embodiments, air or other fluids that is delivered past the heating device (e.g., through the spaces defined between adjacent fins 854C, 864C) can be selectively heated. Thus, such heating devices can be placed in fluid communication with a fluid transfer device (e.g., blower, fan, etc.) to deliver heated air or other fluids to targeted portions of a seating assembly or other locations.

According to some embodiments, heating device include an electrically non-conductive substrate that is configured to receive electrically conductive materials along one or more of its surfaces. The non conductive substrate can comprises a heat transfer assembly or any other portion of the heating device. In some embodiments, as illustrated in FIGS. 16, 16B and 16C, such electrically non-conductive substrates comprise one or more fins or other heat transfer members. However, as illustrated in the various embodiments depicted in FIG. 16D, the size, shape and general configuration of substrates 880A-880F can vary, as desired or required for a particular application or use. The substrates can be configured for use in a convective heating system, a conductive heating system and/or a combination convective/conductive heating system. For example, in a conductive heating system, heat produced by an electrically conductive pathway of a heating device is used to heat a surface or region in a generally conductive manner. Thus, an item or region positioned adjacent or near the heater is directly heated directly by the heat produced by the conductive pathways.

In some embodiments, the heat transfer assemblies, other substrates and/or other portions of a heating device can be advantageously formed into a desired shape, size and general configuration. Such components can be manufactured using any one of a variety of methods, such as, for example, injection molding, compression molding, thermoforming, extrusion, casting and/or the like. The non-conductive components can comprise one or more materials, including, without limitation, moldable plastics, other polymeric materials, paper-based products, ceramics and/or the like. Accordingly, the ability to spray, coat, print or otherwise deposit electrically conductive materials along one or more surfaces of such non-conductive heat transfer assemblies or other substrates provides greater design flexibility of convective and/or conductive heating assemblies. Further, the use of such components and production methods can advantageously reduce costs and facilitate the manufacture of heating devices. For example, by spraying, coating, printing, plating or otherwise depositing the conductive pathways on a non-conductive substrate, a heating device can be manufactured with a unitary structure. As a result, the need to join or otherwise maintain separate components (e.g., a heater, one or more heat transfer assemblies, etc.) of a heating device to each other is reduced or eliminated.

Figure 18:
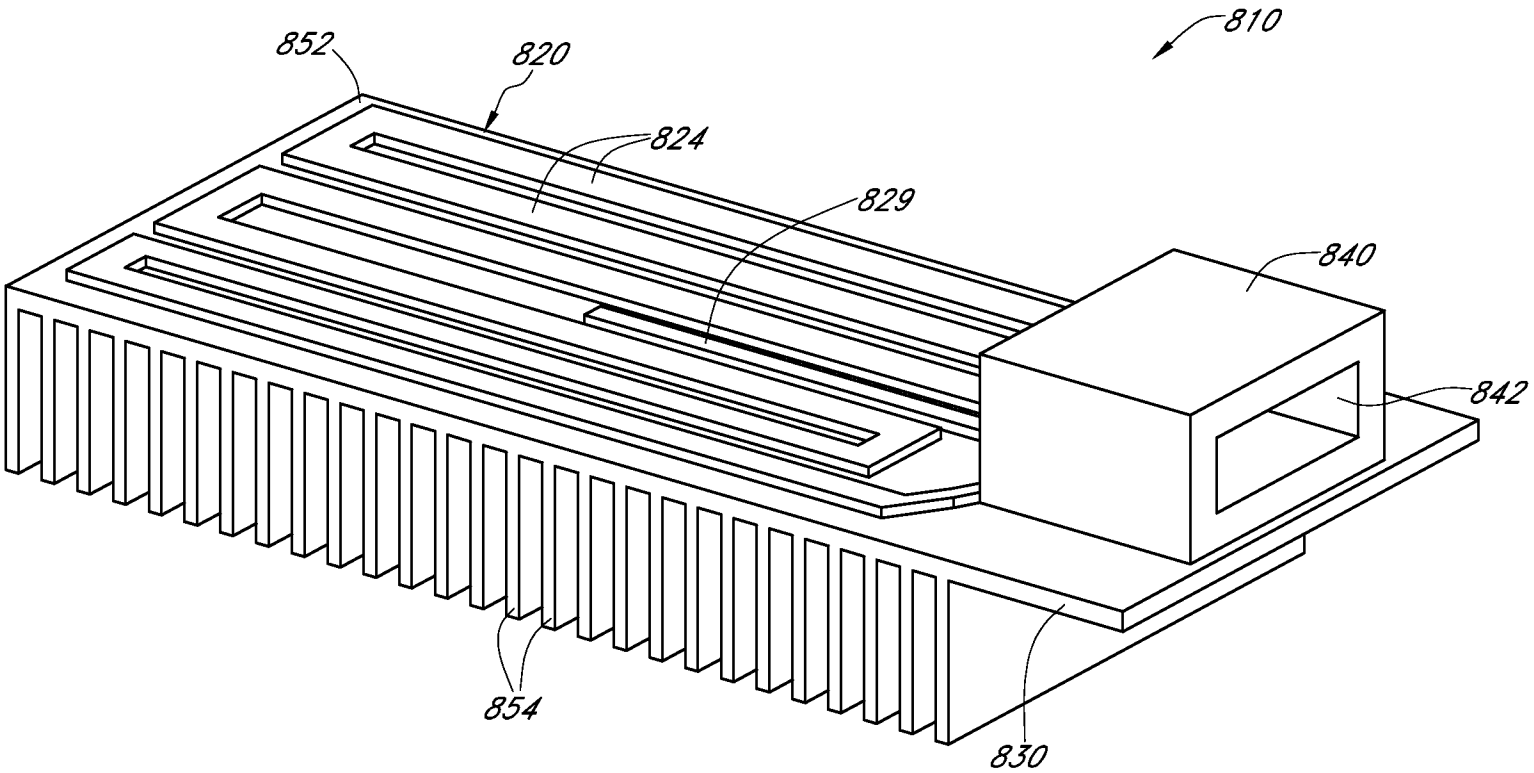
FIG. 18 illustrates a perspective view of the heating device of FIG. 16A comprising an electrical connector according to one embodiment.
Figure 19:
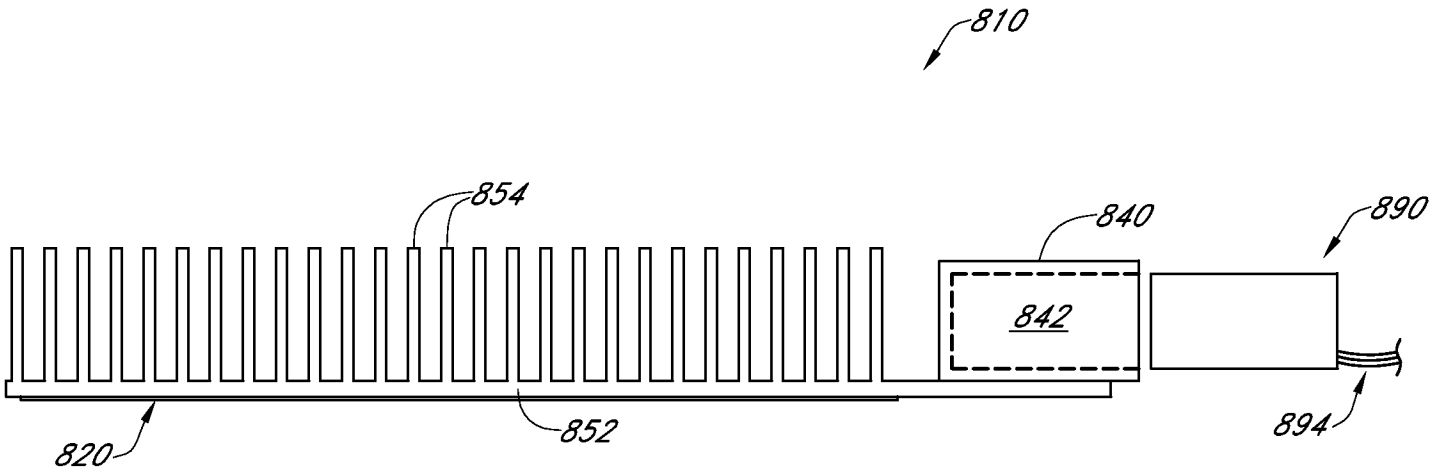
FIG. 19 illustrates a front view of the heating device of FIG. 18.

In any of the embodiments disclosed herein, or equivalents thereof, that utilize the application of electrically conductive materials (e.g., sprays, coating, printing, plating, etc.) to form conductive pathways and/or other conductive components, a heating device can include one or more additional items, components, layers and/or the like. For example, devices that include a sprayed conductive material on a non-conductive heat transfer member, such as the ones illustrated in FIG. 16B or 16C, can include a heat conductive layer, a thermistor, a sensor, a protective layer or coating and/or the like. END In the embodiment illustrated in FIGS. 18 and 19, the heating device 810 includes an electrical connector 840 adapted to receive a power coupling 890. As discussed with reference to other configurations herein, such a connector 840 can offer a convenient and easy way of placing the conductive leads 824, the thermistor 829 and/or other portions of the heater 820 in electrical communication with a vehicle's electrical system, a battery, another type of AC or DC power supply and/or the like. As shown in the depicted embodiment, the connector 840 can be positioned along a protruding portion 830 of the assembly's base 852, generally along the edge of the heating device 810. Alternatively, the connector 840 can be positioned along any other portion or area of the base 852 or heating device, as long as it is electrically connected to the conductive portions of the heater 820.

Figure 20:
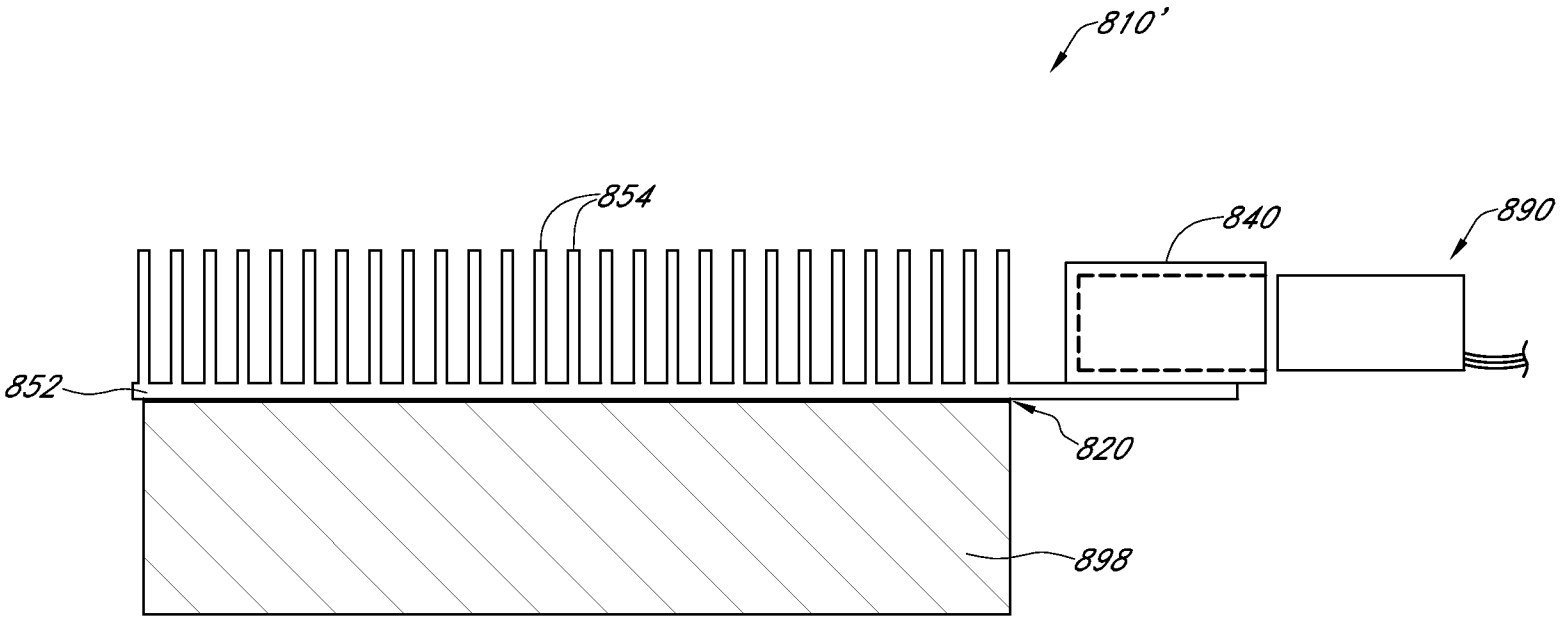
FIG. 20 illustrates a front view of a heating device comprising a heat sink according to one embodiment.

With reference to FIG. 20, a heating device 810' can comprise a heat sink 898 along or near the surface of the base 852 on which the conductive leads and other components of the heater 820 are positioned. Thus, heat can be dissipated away from the heater 820 both toward and away from the main fins 854 or other main heat transfer members. This can further enhance the operation of the heater 820 and/or other components of the device 810'. In other embodiments, the conductive leads, the thermistor and/or other conductive portions of the heater 820 can be thermally insulated so as to reduce heat loss in a direction generally away from the fins 854 or other heat transfer members of the device 810'.

Figure 21A:
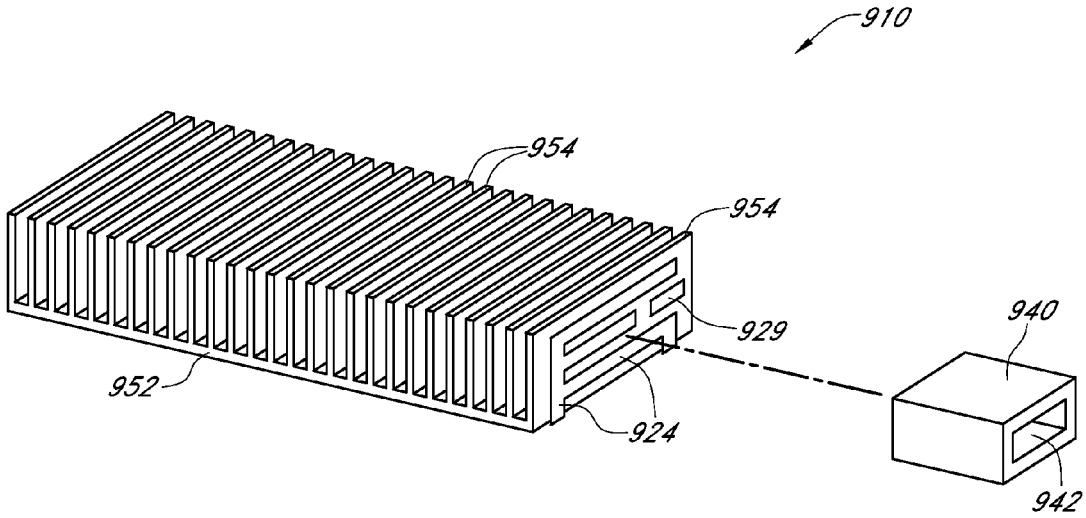
FIGS. 21A and 21B illustrate perspective views of a heating device in which the electrical connector is attached along an end fin according to one embodiment.

Another embodiment of a device 910 configured to selectively heat air or other fluids passing therethrough is illustrated in FIG. 21A. As with the arrangements of FIGS. 16-19, the depicted heating device 910 incorporates the various components of the heater (e.g., conductive leads, thermistor, etc.) into a unitary structure with the heat transfer assembly. Thus, the heat transfer assemblies need not be separate from the heater. In FIG. 21A, the conductive leads 924, thermistor 929 and/or other conductive members of the heater are positioned, at least in part, along the side of an end fin 954 or other heat transfer member. In some embodiments, such conductive leads or other members are positioned along the bottom surface of the base 952 (e.g., similar to the arrangement of FIGS. 16-19), either in lieu of or in addition to being disposed along one or more fins 954. As discussed in greater detail above, the conductive pathways and/or other electrically conductive components or portions of such heating devices can be manufactured using one or more conductive materials that are selectively deposited (e.g., using spray coating, dip coating, other coating technologies, printing, etc.) onto a non-conductive substrate.

Figure 21B:
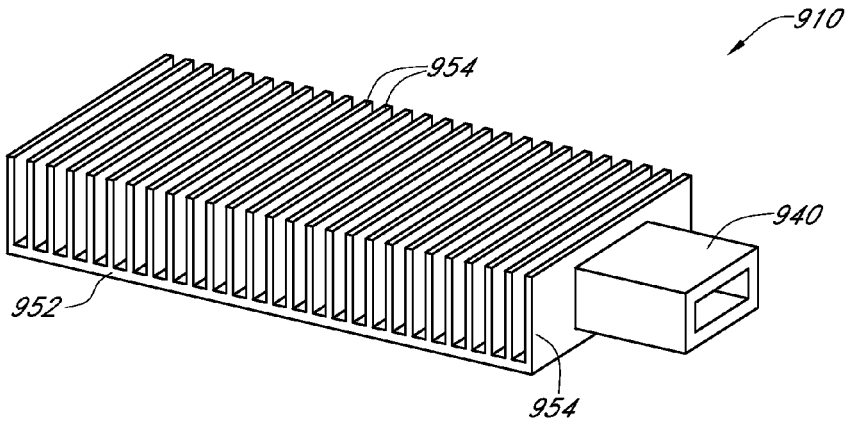

As illustrated in FIG. 21B, a connector 940 can be attached to the side of the end fin 954 or other heat transfer member to permit a convenient way of connecting the heating device 910 to a power source (e.g., a vehicle's electrical system, a battery, another AC or DC power source, etc.) or other electrical component or system. Thus, the connector 940 can be placed in electrical communication with the conductive leads 924, thermistor 929 and/or other conductive members of the heater. As discussed in greater detail herein, a housing, wrap or other outer member can be used to partially or completely surround the heating device 910. Such a housing, wrap or other outer member can be used with any of the embodiments of a heating device disclosed herein, or equivalents thereof, as desired or required.

Figure 22A:
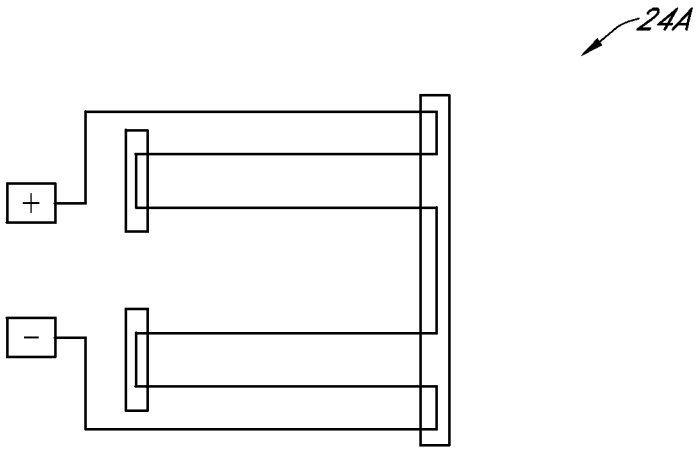
FIG. 22A illustrates a schematic layout of conductive leads used in a heating device according to one embodiment.

FIG. 22A schematically illustrates one embodiment of a layout of conductive leads 24A for use in any of the heating devices disclosed herein or equivalents thereof. As shown, the leads 24A can comprise a path created by traces of one or more electrically-conductive materials (e.g., silver, other metals or alloys, etc.). Electrical current delivered through the heating device can be converted to heat as a result of the electrical resistance within the conductive members (e.g., silver traces). In such embodiments, the conductive leads can continue to transmit electricity therethrough even if when the operating temperature of the heater is relatively high. Thus, a heating device can include a thermistor or other temperature-regulating component or feature to help protect the device against excessive temperatures that may be damaging or dangerous to the system or user.

Figure 22B:
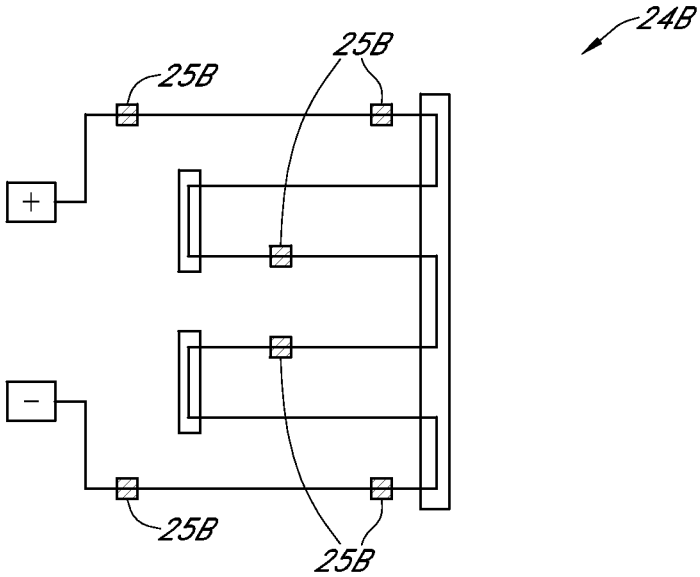
FIG. 22B illustrates a schematic layout of conductive leads used in a heating device according to another embodiment.

Another embodiment of a conductive lead scheme is illustrated in FIG. 22B. In the depicted arrangement, the circuit comprises a plurality of bridges 25B or breakers that are configured to be less robust with respect to temperature resistance than the main conductive leads. Thus, as the heater reaches a particular threshold operating temperature, these bridges 25B can be adapted to fail, thereby protecting the heater and other portions of the heating device against potentially damaging or dangerous over-temperature conditions. As a result, such a configuration can eliminate the need for thermistors and/or other temperature-regulating components or features. Such bridges 25B may be incorporated into any of the heating device embodiments disclosed herein or equivalents thereof. As noted above, the conductive leads can include conductive materials that have been sprayed, coated, printed, plated and/or otherwise deposited onto one or more surfaces or portions (e.g., a base of a heat transfer assembly) of a heating device.

Figure 22C:
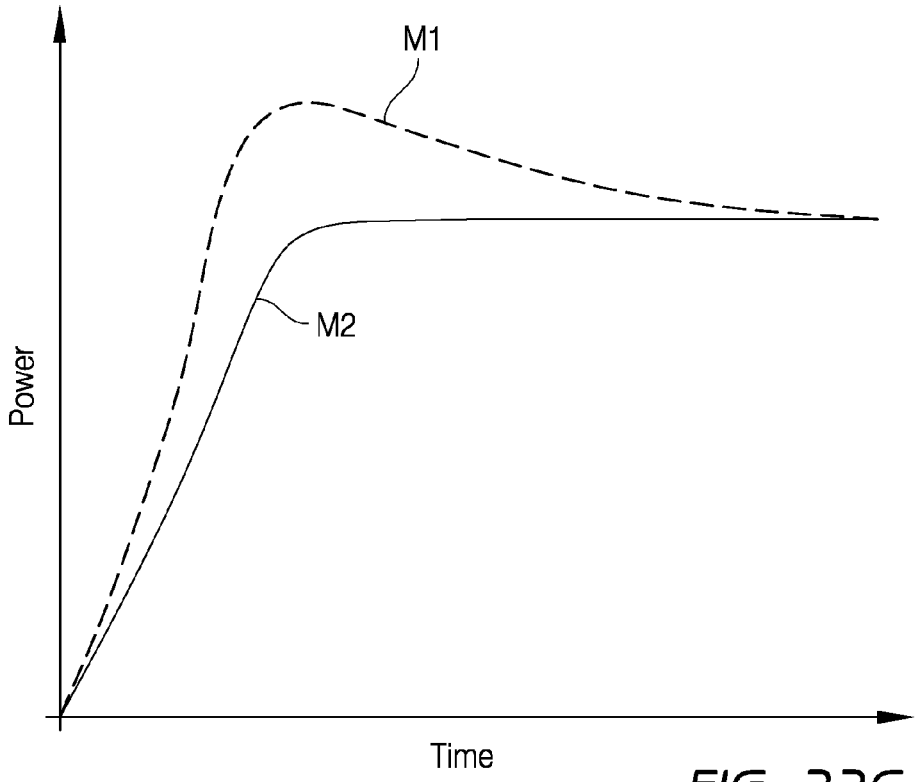
FIG. 22C schematically illustrates a chart showing the relationship between power output of a heating device and time for different conductive materials.

According to some embodiments, regardless of their exact details (e.g., type, form, size, shape, orientation, etc.), the conductive materials that are included in the electrical leads, busses, pathways, and/or other conductive portions of a heating device configured to convert electrical current to heat can be selected based on a target Thermal Coefficient of Resistance (TCR), target TCR range and/or similar electrical property. For example, in some embodiments, the conductive materials comprise a relatively stable TCR over the expected operational temperature range of the heating device. As a result, the power output of the conductive materials, and thus the amount of heat produced, will increase relatively gradually over time (e.g., from the time the heating device is activated to a later point in time), as the power output is not significantly affected by the actual temperature of the device. This is schematically represented by the M2 graph illustrated in FIG. 22C. In some embodiments, such relatively stable materials comprise a TCR value between about 0 and 1,000 ppm/° C., such as, for example, about 400, 500 or 600 ppm/° C. In other embodiments, such relatively stable materials comprise a TCR value between about 1,000 and 1,500 ppm/° C. or higher, such as, for example, about 1,200 or 1,300 ppm/° C.

Figure 22D:
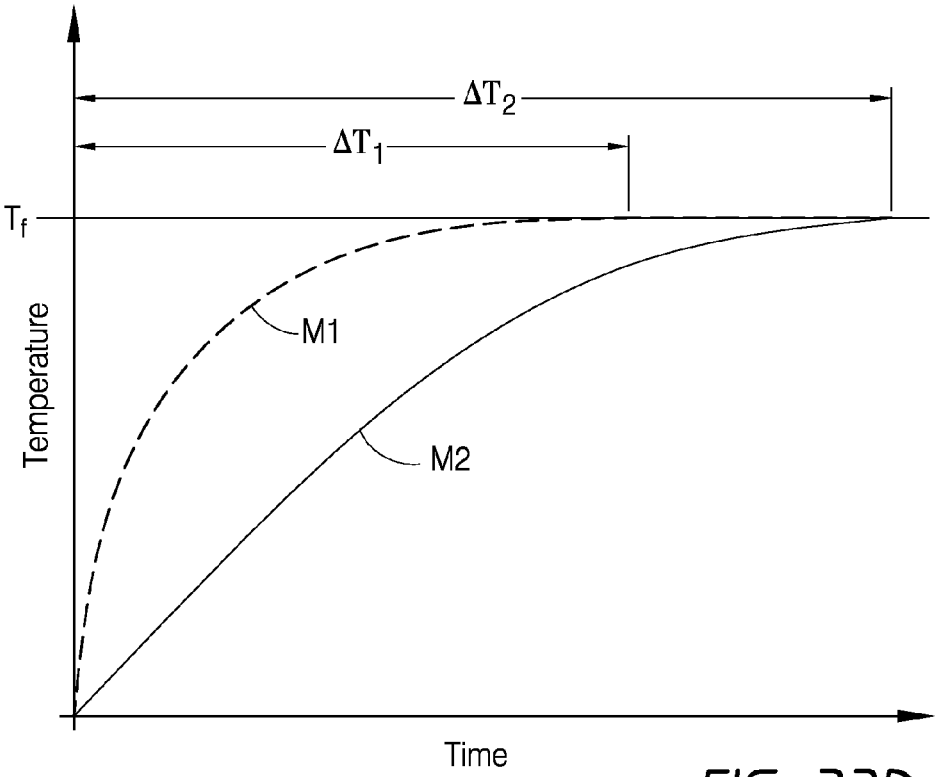
FIG. 22D schematically illustrates a chart showing the change in temperature on or along a heater of a heating device over time for different conductive materials.

Relatedly, FIG. 22D schematically illustrates a graphical comparison of temperature of a heating device (e.g., on or near the conductive materials, along the fins or other heat transfer members of the device, etc.) over time for materials having varying TCR properties. As shown, the temperature for heating devices using conductive materials M2 with a relatively stable TCR value or range will increase more gradually (e.g., in a linear or generally linear manner) over time. This is due, in part, because the power output for heating device utilizing such conductive materials is generally stable over the operational temperature range of the device.

In other embodiments, the conductive materials that are included in the electrical leads, busses, pathways and/or other conductive portions of a heating device comprise a higher TCR value or range and/or similar electrical property. For example, in some embodiments, such conductive materials comprise a relatively unstable TCR over the expected operational temperature range of the heating device. As a result, the power output of the conductive materials, and thus the amount of heat produced by the heating device, will increase more rapidly when the heating device is relatively cool (e.g., when the heating device is initially activated) in comparison to conductive materials with generally stable TCR values. Consequently, the temperature at or near the heat transfer elements (e.g., fins) that are in thermal communication with the conductive materials of the heater will increase more rapidly than when conductive materials having more stable TCR properties are used. This is schematically represented by the M1 graph illustrated in FIG. 22C. In some embodiments, such relatively unstable materials comprise a TCR value between about 1,500 and 5,000 ppm/° C. or higher, such as, for example, between about 1,500 and 3,500 ppm/° C., between about 3,000 and 4,000 ppm/° C. (e.g., about 3,300, 3,400 or 3,600 ppm/° C.). Therefore, in circumstances where the voltage supplied to a heating device is maintained constant or generally constant, the use of such relatively unstable conductive materials can provide a more robust relationship between heat production (and thus, temperature along the heat transfer members of the heating device) and time. Consequently, as illustrated in FIG. 22D, in some circumstances, a target final temperature ($T_f$), can be achieved in a shorter time period, $\Delta T_1$, by using conductive materials having relatively unstable TCR values as compared to using conductive materials having more stable TCR values (e.g., $\Delta T_2 > \Delta T_1$). This shorter time period can be attributed, at least in part, on the higher power output values exhibited by such conductive materials at the lower operational temperature of a heating device. However, with continued reference to FIGS. 22C and 22D, as long as the conductive materials are selected for a target TCR at the high end of the expected operational temperature range, the target maximum power output and the final temperature $T_f$ can be achieved by the heating device regardless of variations to such values that may occur at lower temperatures.

The use of relatively unstable conductive materials, such as, for example, materials having a TCR above about 1,500 ppm/° C. (e.g., between about 3,000 and 4,000 ppm/° C.) can advantageously allow the heating device to heat up more rapidly when the heating device is initially activated (e.g., when the temperature of the heating device is identical or similar to the ambient temperature). Accordingly, the seating assembly (e.g., vehicle seat, bed, etc.) and/or any other item or region that is being selectively thermally-conditioned (e.g., convectively and/or conductively) by the heating device can be warmed faster, providing an enhanced or improved comfort level to an occupant, especially when ambient temperatures are relatively cold. According to some embodiments, the relatively unstable conductive materials include a lower concentration of ruthenium than conductive materials having relatively more stable TCR characteristics.

Figure 23:
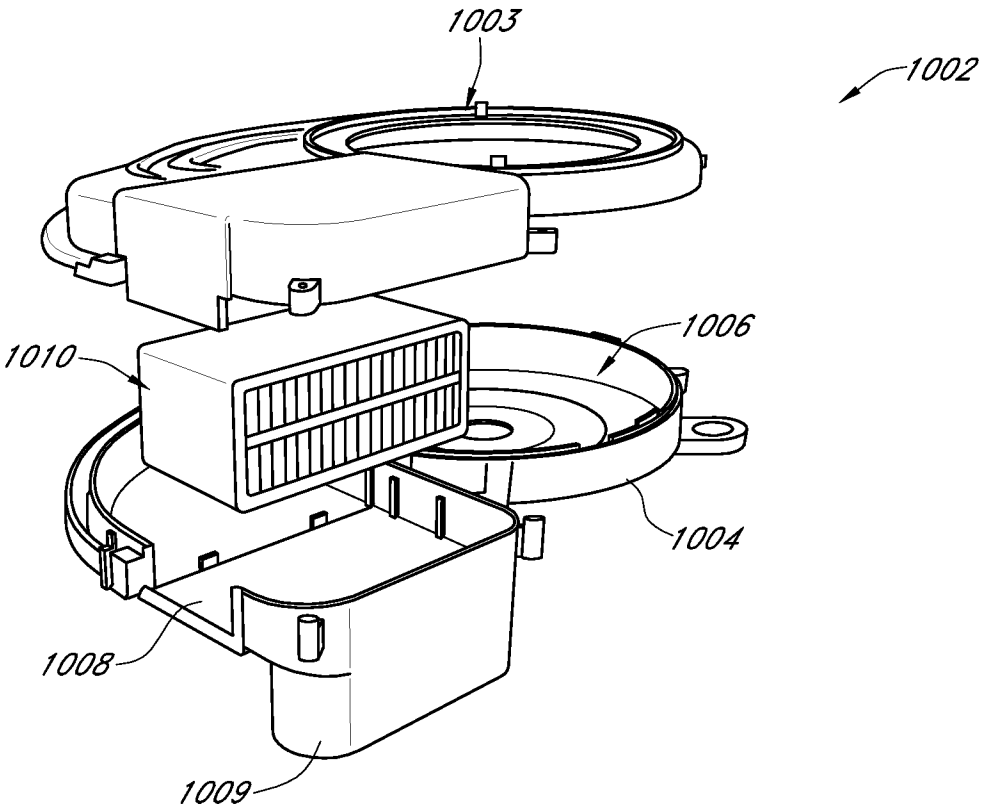
FIG. 23 illustrates an exploded perspective view on the fluid module comprising a heating device according to one embodiment.
Figure 24:
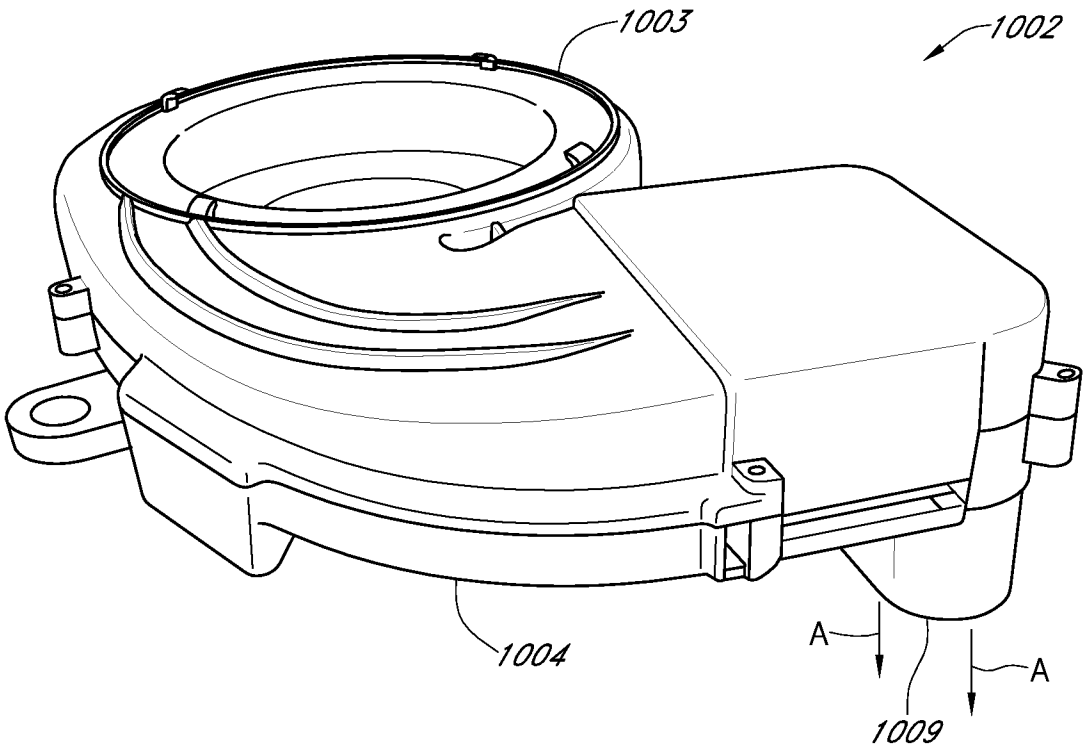
FIG. 24 illustrates a perspective view of the fluid module of FIG. 23.

FIGS. 23 and 24 illustrate a fluid module 1002 that includes a heating device 1010 configured to selectively heat air or other fluids in accordance with the embodiments and features discussed and illustrated herein. As shown, the fluid module 1002 can comprise an outer housing 1003, 1004 that generally defines an interior space. In the depicted arrangement, the module 1002 includes a first housing portion that is permanently or removably joined to a second housing portion 1004 using one or more connection devices or methods (e.g., screws, bolts, clips, other fasteners, welds, adhesives and/or the like). Alternatively, the housing can include more or fewer portions as desired or required.

With continued reference to FIGS. 23 and 24, the fluid module 1002 can include an interior cavity 1006 that is adapted to receive a fan or other fluid transfer device. In addition, the module 1002 can include an interior area 1008 that is sized, shaped and otherwise configured to receive a heating device 1010. Accordingly, ambient air or other fluid can be drawn into an inlet of the module 1002 and selectively moved through the heating device 1010 and a downstream outlet 1009 by a fan or other fluid transfer device. Thus, when the heating device 1010 is electrically energized (e.g., when current is delivered to the heating device 1010), the air or other fluid passing therethrough can be selectively heated, as desired or required. In other arrangements, the heating device 1010 is not positioned within the fluid module 1002. Thus, the heating device 1010 can be located upstream or downstream of a fluid module 1002, fluid transfer device and/or the like. Regardless of the exact orientation of the various components that comprise a fluid delivery system, air or other fluid can be convectively heated as it is passed through a heater 1010.

As discussed, any of the various heating devices disclosed herein can be used to provide thermally conditioned air or other fluids to climate controlled seating assemblies (e.g., automobile or other vehicle seats, office chairs, sofas, wheelchairs, theater or stadium seats, other types of chairs, hospital or other medical beds, standard beds, etc.) or other devices or assemblies.

Figure 25:
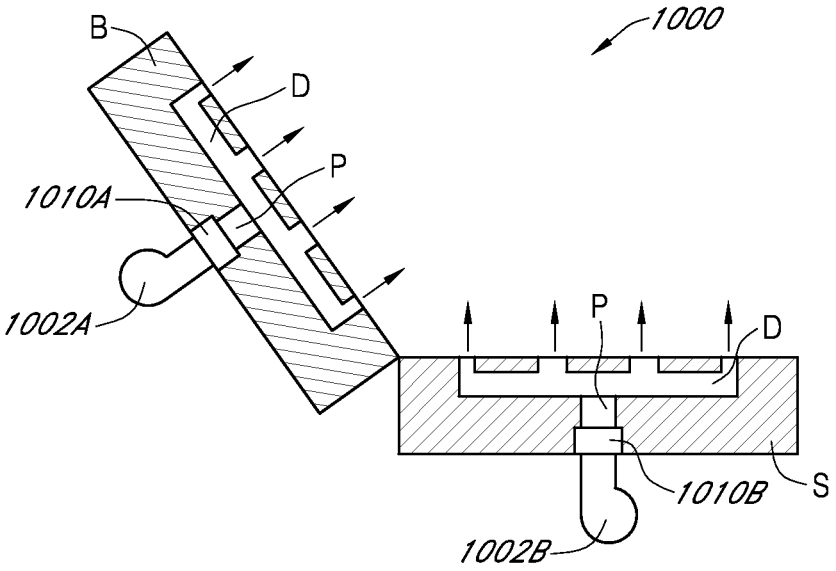
FIG. 25 schematically illustrates a climate controlled seat assembly comprising two heating devices according to one embodiment.

FIG. 25 schematically illustrates one embodiment of a climate controlled seat 1000 having a seat bottom portion S and seat back portion B. The seat bottom portion S and/or the seat back portion B can be configured to receive thermally-conditioned air or other fluids. For example, as shown, each of the portions S, B can include one or more internal fluid passages P and a flow distribution/conditioning members D. Thus, air or other fluids directed into a passage P of the seat back portion B and/or seat bottom portion S by a fluid transfer device 1002A, 1002B can pass through a downstream flow distribution/conditioning member D, toward a seated occupant. A heating device 1010A, 1010B can be positioned upstream or downstream of and/or within a fluid transfer device 1002A, 1002B to selectively heat the air or other fluid being delivered toward the occupant. As discussed herein, such heating devices may include stand-alone devices with or without an outer housing, outer wrap or other enclosure. Alternatively, a heating device may be positioned within a housing of a module or other component of a climate control system, as desired or required.

Figure 26:
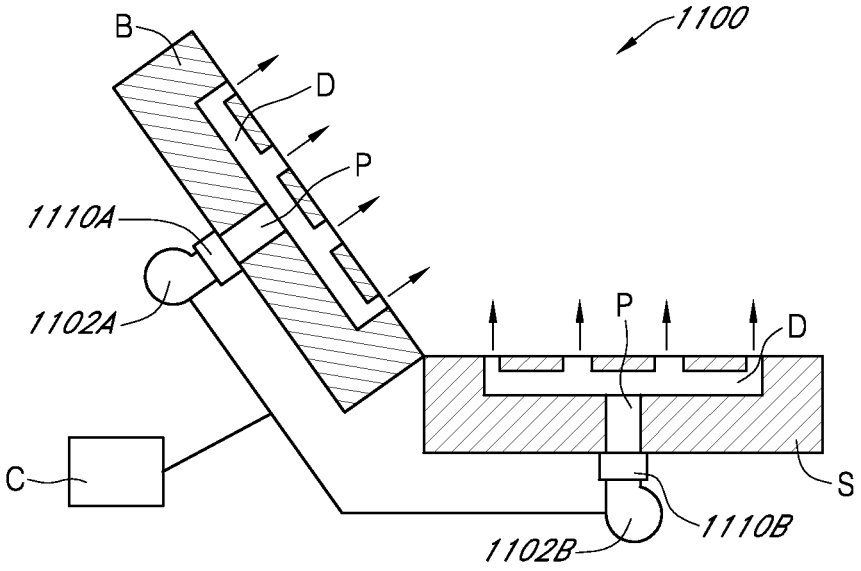
FIG. 26 schematically illustrates a climate controlled seat assembly comprising two heating devices operatively connected to a control unit according to one embodiment.

The arrangement of a climate controlled seat assembly 1100 schematically depicted in FIG. 26 additionally includes a controller C that is in electrical and/or data communication with the fluid transfer devices 1102A, 1102B, heating devices 1110A, 1110B, sensors and/or any other component of the system. The controller C can be configured to maintain a desired heating effect or temperature setting along an exterior portion of the seat assembly. Thus, the seat 1100 can include one or more temperature sensors (not shown in FIG. 26) within its passages P, within its flow distribution/conditioning members D, along selected areas of the seat back portion B and/or seat bottom portion and/or the like. In other embodiments, a climate controlled seating assembly can include more or fewer (or different) components or features.

Figure 27:
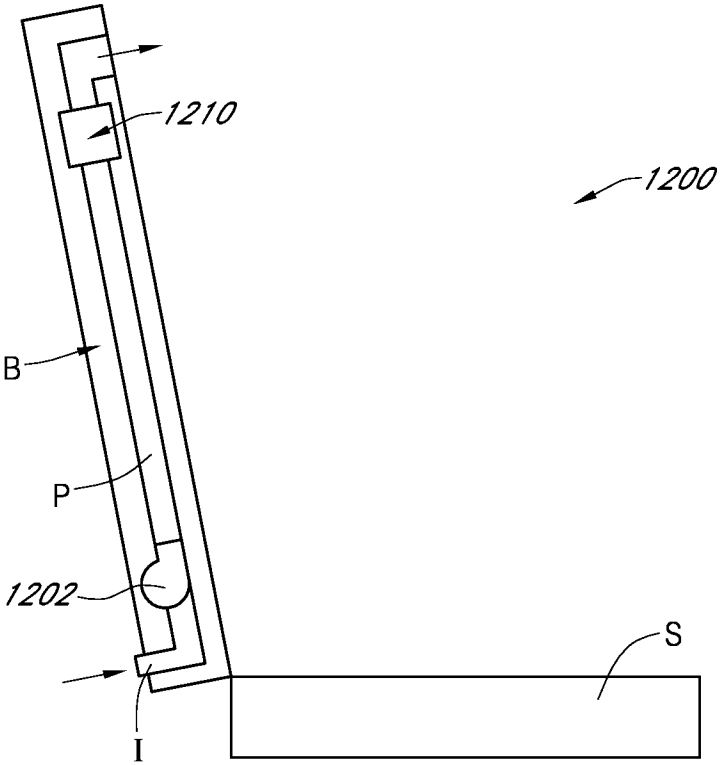
FIG. 27 schematically illustrates a climate controlled seat assembly comprising a single heating device configured to selectively heat fluids being delivered to the neck region of the seat back portion according to one embodiment.

FIG. 27 schematically illustrates one embodiment of a fluid heating device 1210 positioned within a portion of a seating assembly 1200 (e.g., an automotive seat, chair, sofa, bed, wheelchair, stadium seat, etc.). In the illustrated embodiment, the heating device 1210 is situated in the seat back portion B of the seating assembly 1200. As shown, a fluid transfer device 1202 can be used to draw air or other fluid into an inlet duct I. The air can then be transferred by energy imparted on it by the fluid transfer device 1202 (e.g., fan, blower, etc.) to a discharge conduit P or other passage. Air delivered into the discharge conduit P can be channeled through one or more heating devices 1210 where it is selectively heated to a desired level. Heated air or other fluid exiting the heating device 1210 can be directed to one or more portions of the seating assembly 1200. For example, in the illustrated embodiment, heated air is directed to the headrest region of the seat back portion B of the seat. In some arrangements, the heated air is incorporated into a neck or head warmer. In other arrangements, the heating system does not include an inlet duct I or other similar member. Thus, air or other fluid can be drawn directly into an inlet of a fluid transfer device 1202 (e.g., blower, fan, etc.).

In other embodiments, a heating system can be configured to provide spot heating to one or more other locations of an automobile interior (e.g., leg area, feet area, headliner, visor, A, B or C pillars, etc.), a building interior (e.g., ottoman, leg rest, bed, etc.) and/or the like. In still other embodiments, heated air can be delivered to and distributed through a larger area of a seat back portion B and/or a seat bottom portion S of a seating assembly. Therefore, a fluid heating device can be incorporated into a seat warming system. For example, a distribution system (FIGS. 25 and 26) positioned downstream or upstream of a heating device can be configured to deliver heated air through one or more cushioned areas of the seat back portion B and/or the seat bottom portion S of seating assembly. Further, such fluid heating devices and systems can be used to "spot warm" particular targeted regions of a seating assembly. For example, in some embodiments, a seating assembly comprising such a heating device can be configured to selectively deliver heated air to one or more locations. As discussed, such seating assemblies may be equipped with a control system to allow a user to choose where (and/or to what extent) heated air is delivered.

Figure 28A:
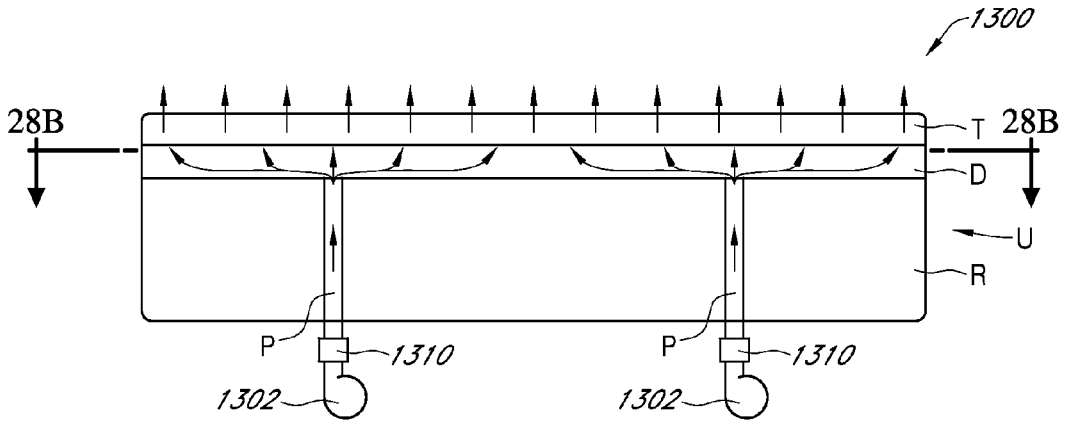
FIG. 28A illustrates a side cross-sectional view of a climate controlled bed comprising heating devices according to one embodiment.
Figure 28B:
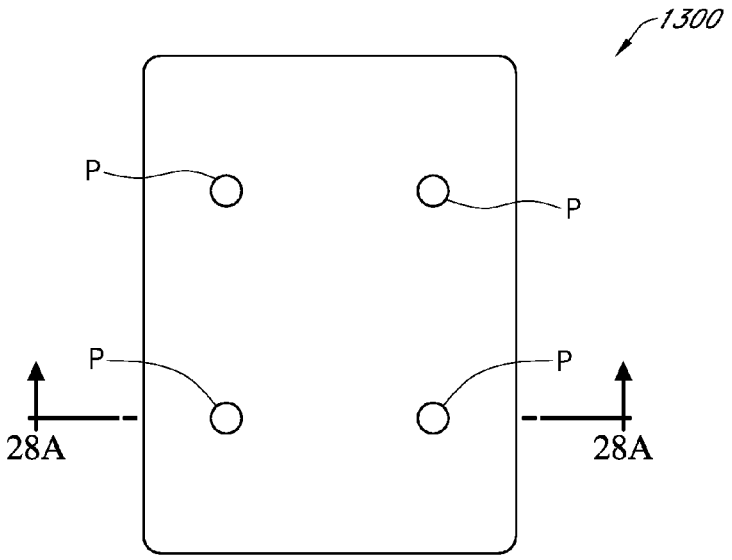
FIG. 28B illustrates a top cross-sectional view of the climate controlled bed of FIG. 28A.

FIGS. 28A and 28B schematically illustrate one embodiment of an upper portion U of a climate controlled bed assembly 1300. In the depicted embodiment, the upper portion U comprises a core R which includes four internal passageways P through its depth. As shown, the passageways P can have a generally cylindrical shape. However, the passageways P can include any other cross-sectional shape, such as, for example, square, rectangular, triangular, other polygonal, oval, irregular and/or the like. Further, in some arrangements, the passageways P are symmetrically arranged along the core R. This can allow the upper portion U to be rotated relative to the lower portion (not shown) while still allowing the passageways P to generally align with any fluid modules 1310 positioned within a lower portion. Alternatively, the passageways P of the core R can include a non-symmetrical orientation. Further, in other embodiments, the core R includes more or fewer than four internal passageways P, as desired or required by a particular application or use. In addition, the size, shape, spacing, orientation and/or any other details of the passageways P and/or the core R can be different than illustrated or discussed herein.

The core R can comprise one or more materials or components, such as, for example, foam, other thermoplastics, filler materials, air chambers, springs and/or the like. Although not illustrated in FIGS. 28A and 28B, the upper portion U is preferably positioned on a lower portion. The passageways P of the core R can be configured to generally align with openings in the lower portion so as to place the passageways P in fluid communication with one or more fluid modules (e.g., fans, blowers, etc.). A heating device 1310 in accordance with one of the embodiments disclosed herein may be positioned within, upstream and/or downstream of each fluid module 1302, as desired or required. Thus, as shown, air or other fluids can be heated before or while being conveyed through the passageways P of the core R, toward one or more layers or components situated above the core R.

For example, as illustrated in FIG. 28B, heated air or other fluids can be directed from the passageways P into a fluid distribution member D (e.g., spacer, spacer fabric or other material) or any other member that is generally configured to help receive and distribute air or other fluid along a desired top area of the bed 1300. From the fluid distribution member D, heated air or other fluid can pass through one or more layers or members located along the top of the bed 1300. By way of example, in FIG. 28B, the upper portion U comprises a comfort layer T (e.g., quilt layer) that is configured to allow air or other fluid to diffuse through it. The top portion of the bed can comprise one or more other comfort layers, fluid distribution members and/or the like, to achieve a desired feel (e.g., firmness), comfort level, fluid distribution scheme, other effect and/or the like.

Figure 29:
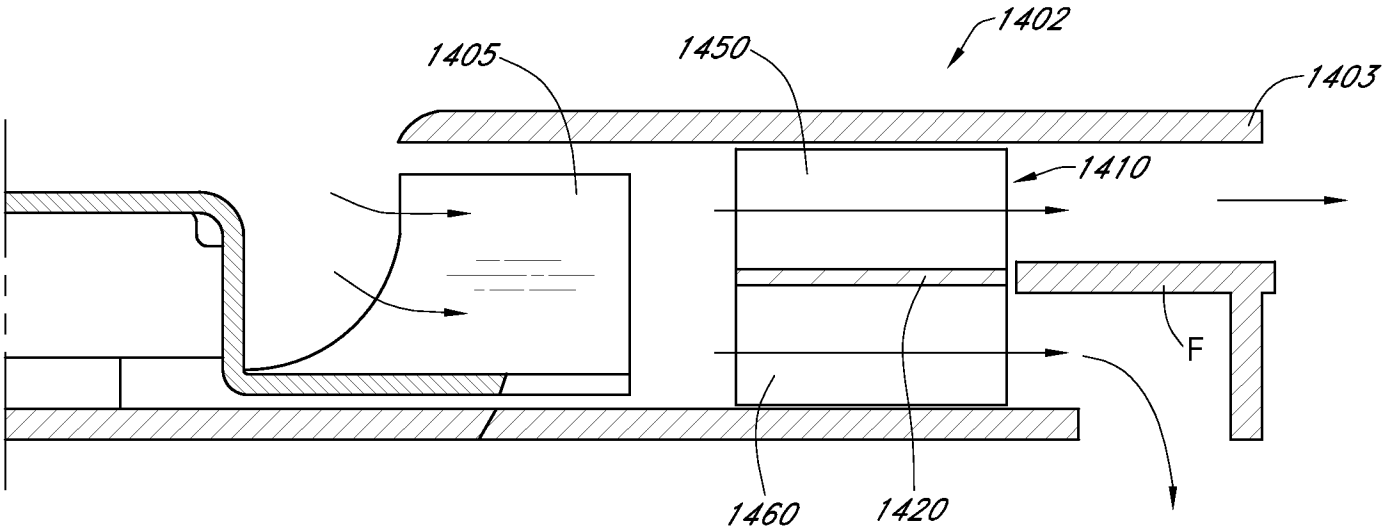
FIG. 29 illustrates a partial cross-sectional view of a fluid transfer device comprising a heating device within its housing according to one embodiment.

FIG. 29 is a cross-sectional view along the circumferential edge of one embodiment of a fan 1402 or other fluid transfer device. Because of the generally rotational symmetry of the fan 1402 around a central axis, FIG. 29 shows approximately only one half of the fan 1402. The housing 1403 of the fluid transfer device 1402 can comprise a top portion and a bottom portion. In the illustrated arrangement, a flow director F is disposed between the top and bottom portions of the housing 1403. A motor-impeller assembly 1405 can be centrally mounted within the cavity defined by the housing 1403. As shown, a heating device 1410, in accordance with any of the embodiments disclosed herein or equivalents thereof, can be positioned within the housing 1403 of the fluid transfer device 1402. Thus, as air or other fluids enter into the cavity of the fan 1402, they can be directed by the moving impeller 1405 through the heating device and toward the outer periphery of the housing 1403. In the illustrated embodiment, flow exiting the heating device 1410 is divided by the flow director F. However, in other embodiments, such as the one illustrated in FIG. 30, the entire or substantially the entire portion of heated air or other fluid exiting the heating device 1510 is directed to a single fan outlet.

Figure 30:
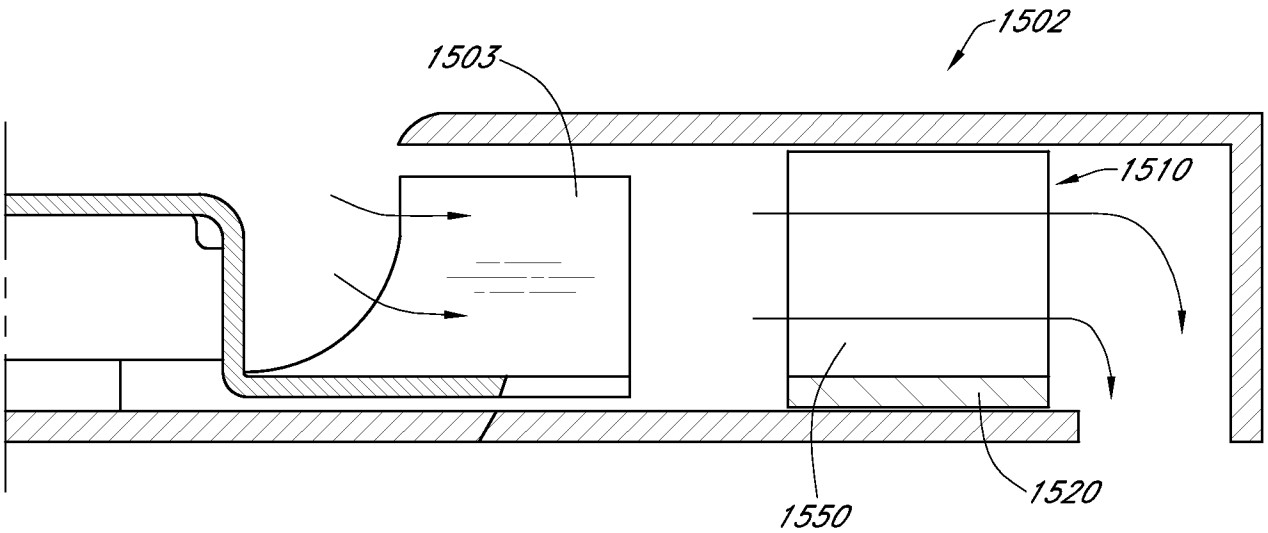
FIG. 30 illustrates a partial cross-sectional view of a fluid transfer device comprising a heating device within its housing according to another embodiment.

With continued reference to FIG. 29, the heating device 1410 comprises a heater 1420 generally positioned between upper and lower heat transfer assemblies 1450, 1460. Alternatively, as depicted in FIG. 30, a fan 1502 or other fluid transfer device can comprise a heating device 1510 that includes a heater 1520 attached to only a single heat transfer assembly 1550. In other embodiments, the heating device 1410, 1510 includes a unitary heater/heat transfer assembly as discussed herein with reference to FIGS. 16-19. The interior cavity of the fan housing can be shaped, sized and otherwise configured to receive one or more heating devices 1410, 1510. According to some arrangements, a housing can be adapted to receive one, two or more heating devices to achieve a desired heating effect. In other arrangements, a fan or other fluid transfer device includes both heating devices and one or more other fluid conditioning devices that are configured to selectively heat and/or cool air or other fluids (e.g., Peltier devices, other thermoelectric devices, other heating or cooling devices, etc.).

Any of the embodiments of a heating device disclosed herein, or equivalents thereof, can be used in conjunction with a thermoelectric device (e.g., Peltier device) and/or any other thermal-conditioning device. Thus, a climate control system of a seating assembly can include a thermoelectric device and/or a heating device, as desired or required. Further, a climate control system can be adapted to simply provide air or other fluids to one or more portions of a seat assembly that are not thermally conditioned (e.g., ambient air for ventilation purposes only). Accordingly, a climate control system that incorporates a heating device according to any of the embodiments disclosed herein can be adapted to selectively provide heated air by activating the heating device and delivering air or other fluids through it. However, the same climate control system can provide non-thermally conditioned air by delivering air or other fluids (e.g., via a fluid transfer device) while the heating device is deactivated. Thus, ventilated air or other fluids can be delivered to a climate controlled seat assembly to provide some level of comfort to a seated occupant.

Additional disclosure regarding climate-controlled seats, beds and other assemblies is provided in U.S. patent application Ser. Nos. 08/156,562 filed Nov. 22, 1993 (U.S. Pat. No. 5,597,200); 08/156,052 filed Nov. 22, 1993 (U.S. Pat. No. 5,524,439); 10/853,779 filed May 25, 2004 (U.S. Pat. No. 7,114,771); 10/973,947 filed Oct. 25, 2004 (U.S. Publ. No. 2006/0087160); 11/933,906 filed Nov. 1, 2007 (U.S. Publ. No. 2008/0100101); 11/872,657 filed Oct. 15, 2007 (U.S. Publ. No. 2008/0148481); 12/049,120 filed Mar. 14, 2008 (U.S. Publ. No. 2008/0223841); 12/178,458 filed Jul. 23, 2008; 12/208,254 filed Sep. 10, 2008 (U.S. Publ. No. 2009/0064411); 12/505,355 filed Jul. 17, 2009 (U.S. Publ. No. 2010/0011502); and U.S. Provisional Application No. 61/238,655 filed Aug. 31, 2009, all of which are hereby incorporated by reference herein in their entireties.

To assist in the description of the disclosed embodiments, words such as upward, upper, bottom, downward, lower, rear, front, vertical, horizontal, upstream, downstream have been used above to describe different embodiments and/or the accompanying figures. It will be appreciated, however, that the different embodiments, whether illustrated or not, can be located and oriented in a variety of desired positions.

Although the subject matter provided in this application has been disclosed in the context of certain specific embodiments and examples, it will be understood by those skilled in the art that the inventions disclosed in this application extend beyond the specifically disclosed embodiments to other alternative embodiments and/or uses of the subject matter disclosed herein and obvious modifications and equivalents thereof. In addition, while a number of variations of the inventions have been shown and described in detail, other modifications, which are within the scope of these inventions, will be readily apparent to those of skill in the art based upon this disclosure. It is also contemplated that various combinations or subcombinations of the specific features and aspects of the embodiments may be made and still fall within the scope of the inventions disclosed herein. Accordingly, it should be understood that various features and aspects of the disclosed embodiments can be combine with or substituted for one another in order to form varying modes of the disclosed inventions. Thus, it is intended that the scope of the subject matter provided in the present application should not be limited by the particular disclosed embodiments described above, but should be determined only by a fair reading of the claims that follow.

What is claimed is:

1. A heating device for convectively heating a fluid, said heating device comprising:

a first heat transfer assembly comprising a plurality of fins, said fins defining a plurality of fin spaces therebetween through which fluids are selectively passed;

a base having a first side and a second side, said first side being generally opposite of said second side;

wherein said base comprises a first end and a second end, said first end being located opposite of said second end;

wherein the plurality of fins extend from and are adjacent the first side of the base;

at least one electrical conducting member positioned along at least a portion of the second side of the base, said at least one electrical conducting member beginning and terminating along the first end of the base and extending at least partially along or near a periphery of said base;

wherein the at least one electrical conducting member is configured to receive electrical current and convert said electrical current to heat;

an outer housing at least partially surrounding the first heat transfer member and said base, wherein said outer housing defines at least one partially enclosed space through which fluids are selectively passed;

an electrical coupling for electrically connecting a first end and a second end of said at least one electrical conducting member, said electrical coupling extending, at least partially, to an exterior of the outer housing;

wherein heat generated at or near the at least one electrical conducting member is transferred to the plurality of fins of the first heat transfer assembly; and wherein fluids directed through the fin spaces within the at least one partially enclosed space are selectively heated when electrical current is provided to the heating device.

2. The heating device of claim 1, wherein the first heat transfer assembly and the at least one electrical conducting member comprise a generally unitary structure.

3. The heating device of claim 1, wherein the at least one electrical conducting member is formed directly on the base of the first heat transfer assembly.

4. The heating device of claim 1, wherein the at least one electrical conducting member is part of a heater secured to the base of the first heat transfer assembly.

5. The heating device of claim 4, wherein the heater comprises a thick film heater.

6. The heating device of claim 1, wherein the at least one electrical conducting member comprises a conductive material positioned on the base of the first heat transfer assembly.

7. The heating device of claim 6, wherein the conductive material comprises a metal.

8. The heating device of claim 6, wherein the conductive material comprises an electrically conductive carbon material.

9. The heating device of claim 6, wherein the conductive material comprises a conductive ink.

10. The heating device of claim 6, wherein the conductive material is deposited on the base using at least one of spraying, coating and printing.

11. The heating device of claim 1, wherein the first heat transfer assembly comprises an electrically non-conductive material.

12. The heating device of claim 1, further comprising an electrical connector in electrical communication with at least one electrical conducting member, said connector being configured to connect to a coupling for the selective delivery of electrical current to the heating device.

13. The heating device of claim 1, further comprising a second heat transfer assembly, said second heat transfer assembly extending in a direction generally away from the second side of the base.

14. The heating device of claim 4, wherein the heater and the first heat transfer assembly are attached using adhesives or thermal grease.

15. The heating device of claim 4, wherein the heater and the first heat transfer assembly are attached using at least one mechanical fastener.

16. The heating device of claim 1, wherein a Temperature Coefficient of Resistance (TCR) of the at least one electrical conducting member is between about 1,500 and 3,500 ppm/° C.

17. A heating device comprising:

a heater having a first surface and a second surface, said second surface being generally opposite of said first surface, said heater being configured to receive an electrical current and convert such electrical current to heat;

at least one heat transfer assembly positioned along and adjacent the first surface of the heater, said heat transfer assembly comprising a plurality of fins, said fins defining a plurality of fin spaces therebetween through which fluids may pass;

an electrically conductive portion positioned along the second surface of the heater, said electrically conductive portion having first and second terminals, said first and second terminals positioned along one end of the heater;

an outer housing at least partially surrounding the heater and the at least one heat transfer assembly; and an electrical coupling for electrically connecting the first and second terminals of the electrically conductive portion, said electrical coupling extending, at least partially, to an exterior of the outer housing;

wherein heat generated by the heater is transferred to the fins of the heat transfer assembly; and wherein fluids passing through the fin spaces are selectively heated when electrical current is provided to the heater.

18. The heating device of claim 17, wherein a Temperature Coefficient of Resistance (TCR) of the electrically conducting portion is between about 1,500 and 3,500 ppm/° C.

19. The heating device of claim 17, wherein the heater comprises a thick film heater.

20. The heating device of claim 17, wherein the electrically conductive portion comprises a conductive material positioned on the base of the first heat transfer assembly.

21. The heating device of claim 20, wherein the conductive material comprises at least one of a metal and an electrically conductive carbon.

22. A seating assembly comprising a support member with at least one fluid passageway, wherein the at least one fluid passageway is in fluid communication with a heating device of claim 17 so as to selectively provide heated air toward a seated occupant of the seating assembly.

23. The seating assembly of claim 22, wherein the seating assembly comprises at least one of a seat and a bed.

24. A heating device comprising:

a heater configured to receive an electrical current to produce heat;

at least one heat transfer assembly adjacent the heater, the heat transfer assembly comprising a plurality of heat transfer members, wherein the heat transfer members define a plurality of spaces therebetween through which fluid may pass;

at least one electrically conductive member positioned on or within the heater, the at least one electrically conductive member terminating along one end of the heater;

wherein the at least one electrically conductive member is configured to produce heat when electrically energized;

an outer housing at least partially surrounding the heater and the at least one heat transfer assembly; and an electrical coupling electrically connecting the at least one electrically conductive member, wherein the electrical coupling extends at least partially to an exterior of the outer housing;

wherein heat generated by the heater is transferred to the at least one heat transfer assembly; and wherein fluid passing through the spaces is selectively heated when electrical current is provided to the heater.

25. A seating assembly comprising a support member with at least one fluid passageway, wherein the at least one fluid passageway is in fluid communication with a heating device of claim 24 so as to selectively provide convectively heated air toward a seated occupant of the seating assembly.

26. The seating assembly of claim 25, wherein the seating assembly comprises a seat or a bed.

* * * * *